United States Patent [19]

Miller

[11] 4,411,189

[45] Oct. 25, 1983

[54] FLUID FLOW CONTROLLING DEVICE

[75] Inventor: Wendell E. Miller, Warsaw, Ind.

[73] Assignee: The Scott and Fetzer Company, Lakewood, Ohio

[21] Appl. No.: 226,394

[22] Filed: Jan. 19, 1981

Related U.S. Application Data

[63] Continuation of Ser. No. 816,865, Jul. 18, 1977, abandoned.

[51] Int. Cl.[3] ..... F15B 11/08; F15B 13/042

[52] U.S. Cl. ..... 91/420; 91/433; 91/436; 91/445; 91/447; 137/596; 137/596.13

[58] Field of Search ..... 137/596, 596.13; 91/445, 447, 420, 436, 433

[56] References Cited

U.S. PATENT DOCUMENTS

| | | | |
|---|---|---|---|
| Re. 29,292 | 7/1977 | Tennis | 137/596 |
| 2,756,724 | 7/1956 | Stewart et al. | 91/420 |
| 3,319,653 | 5/1967 | Stephans | 91/436 |
| 3,470,694 | 10/1969 | Budzich | 60/427 |
| 3,744,517 | 7/1973 | Budzich | 137/596.2 |
| 3,759,144 | 9/1973 | Ikeda | 91/436 |
| 3,807,447 | 4/1974 | Masuda | 137/596.13 |
| 3,866,419 | 2/1975 | Paul | 60/427 |
| 3,878,864 | 4/1975 | Schurger | 137/596.13 |
| 3,910,045 | 10/1975 | Herrmann | 91/441 |
| 3,910,311 | 10/1975 | Wilke | 137/596.12 X |
| 3,995,532 | 12/1976 | Junck et al. | 137/596.13 |
| 4,008,731 | 2/1977 | Ratz | 91/420 X |
| 4,058,135 | 11/1977 | Petro | 137/596 X |

*Primary Examiner*—Arnold Rosenthal
*Attorney, Agent, or Firm*—Wendell E. Miller

[57] ABSTRACT

A fluid flow controlling device includes a flow control that is interposed between the valve spool of a directional control valve and the work port channel of the directional control valve, and that is effective to control fluid flow to and from one motor port of a fluid motor in proportion to respective sizing of first and second fluid flow paths by the valve spool. The fluid flow controlling device is preferably used in load responsive hydraulic systems.

94 Claims, 12 Drawing Figures

11
11
308
310
366
312
430
510
378
368
326
322
388
392
380
390
426
500
498
432
394
522b
446
448
144
176
34
146
416
490
496
428
522a
370
396
314
502a
492
412
436
420
424
488
502b
452
450
442
162
414
360
382
316
342
334
415
422
317
372
344
356
362
384
318
328
494
511
364
510
480
482
476
218
421
417
419
330
478
320
324
358
336
374
351
350
30
226
227
346
332
28
24
26
228
32
162
304
340
306
300
302
338
348

FLUID FLOW CONTROLLING DEVICE

This application is a continuation of application Ser. No. 816,865, filed July 18, 1977, and abandoned in favor of this continuation.

BACKGROUND OF THE INVENTION

1. Field of the Invention

The present invention generally relates to directional control valves of the type in which a flow control is incorporated into the control valve for controlling the rate of fluid flow through the control valve in proportion to selective positioning of the valve spool, and the flow rate is in proportion to the cross-sectional flow area of a fluid flow path that is established and sized by the valve spool positioning.

The present invention also generally relates to load responsive hydraulic systems in which the pump pressure and the effective output of the pump are controlled to maintain the system pressure at a predetermined pressure magnitude above the highest load actuating pressure that exists in a plurality of directional control valves. The control of the pressure and effective output of a variable displacement pump are controlled by control of the pump displacement; and the control of the pressure and effective output of a fixed displacement pump are controlled by a by-pass valve that discharges excess pump flow to a sump.

The present invention specifically relates to load responsive systems in which the system pressure is controlled to a predetermined pressure magnitude above the highest load actuating pressure of a plurality of directional control valves; and at least one directional control valve includes a flow control for reducing the system pressure to a predetermined pressure magnitude above the load actuating pressure of that one control valve; whereby fluid flow to the fluid motor connected to that control valve is substantially proportional to valve spool positioning irrespective of the system pressure.

The present invention more specifically relates to control valves in which flow control means is provided for achieving proportional control of fluid flow both to and from a fluid motor.

2. Description of the Prior Art

Load Responsive Systems

Early load responsive systems were disclosed by Allen, U.S. Pat. No. 2,892,312, in which the displacement of a variable displacement pump was controlled by a highest load actuating pressure, and Lee, U.S. Pat. No. 3,145,734, in which excess fluid output of a fixed displacement pump was by-passed to a sump to maintain the system pressure at a predetermined pressure magnitude above a load actuating pressure.

A more recent load responsive system, and one that may utilize either variable or fixed displacement pumps, is taught by McMillen et al., U.S. Pat. No. 3,693,506.

INLET FLOW CONTROL

The use of a flow control between the pump and the valve spool of the directional control valve was disclosed by Budzich in U.S. Pat. No. 3,470,694. This flow control was responsive to the pressure differential across an inlet throttling orifice, between the pressure inlet port and the work port, that is established and sized by the valve spool. This flow control restricted the fluid flow from the pump to the valve spool of the directional control valve to maintain a substantially constant pressure differential across this inlet throttling orifice even though the system pressure might be raised excessively high for the requirements of this control valve by another control valve actuating a fluid motor at a much higher load actuating pressure.

Flow controls interposed between the pump and the valve spool of the directional control valve have also been disclosed by McMillen, U.S. Pat. No. 3,592,216; Farrell et al., U.S. Pat. No. 3,774,635; and Kroth et al., U.S. Pat. No. 3,903,787. The flow control of McMillen also performs other functions such as the load check function.

OUTLET CONTROL

A directional control valve has been disclosed by Tennis, U.S. Pat. No. Re. 29,292, in which a flow control is interposed between the valve spool and a work port for the control of fluid being returned from a fluid motor to the directional control valve. The flow control is responsive to the velocity of fluid which is being exhausted through the return flow throttling orifice that is established and sized by the valve spool.

INLET CONTROL AND CASCADING

Flow controls interposed between the pump and the valve spool of each directional control valve have also been adapted to cascade excess flow from one control valve to another, thus giving priority to upstream control valves. This category of prior art includes McAlvay et al., U.S. Pat. No. 3,465,519; Hodgson, U.S. Pat. No. 3,782,404; and Young, U.S. Pat. No. 3,908,375.

INLET AND OUTLET CONTROL

Throttling of both inlet flow to a fluid motor and outlet flow from a fluid motor is taught by Walters, U.S. Pat. No. 3,903,786. Walters utilizes the throttling orifice, between the pump and the valve spool of the directional control valve, to control the flow control plunger, and then he adapts the flow control plunger to also throttle fluid flow from the fluid motor to the sump. Walters' device restricts the flow of fluid from the motor to the sump; but the flow control is actuated by the pressure drop across an inlet throttling orifice; so that proportional control of the lowering of a heavy gravity load is not achieved.

Masuda, in U.S. Pat. No. 3,807,447, disclosed a directional control valve in which a single flow controlling plunger is used as a by-pass valve to control the effective output of the pump, as a flow control to control inlet flow from the pump to the fluid motor, and as a flow control to control outlet flow from the fluid motor to the sump. Since an inlet throttling orifice is used to control the flow control, the device does not necessarily provide proportional control of a heavy gravity load.

Budzich, in U.S. Pat. No. 3,744,517, in divisional U.S. Pat. No. 3,858,393, and in continuation-in-part U.S. Pat. Nos. 3,882,896 and 3,984,979, discloses a directional control valve in which a first flow control is interposed between a pair of return channels and a return port, and in which the first flow control is actuated by the pressure differential across and outlet-throttling orifice which is established between a work port and the return channels. Thus Budzich recognized the importance of controlling the lowering of gravity loads. In these same patents, Budzich incorporates a second flow control for the throttling of inlet flow. Budzich does achieve proportional control of the fluid flow rate both to and from a fluid motor at the cost of using two flow controls.

Paul, in U.S. Pat. No. 3,866,419, discloses three embodiments of load responsive directional control valves.

Paul's FIG. 5 embodiment is a four-way valve in which the rate of flow to a double action cylinder is controlled by a flow control that is interposed between the pressure inlet port and the valve spool. Thus this embodiment fails to make any provisions for the control of negative loads.

Paul's FIG. 4 embodiment is a four-way valve in which the rate of return flow from a double action cylinder is controlled by a flow control that is interposed between the valve spool and the work ports and that responds to a pressure drop across an inlet throttling orifice. The limitations of this device are the same as those of Walters and Masuda.

Paul's FIG. 3 embodiment is a three-way valve that incorporates a flow control between the valve spool and the work port, for controlling the rate of fluid flow to a single action cylinder, and for controlling the rate of fluid flow from the cylinder. This device, although it is a three-way valve whereas the present invention is a four-way valve, achieves some of the functional advantages of the present invention.

Wilke, in U.S. Pat. No. 3,910,311, discloses a four-way directional control valve in which two flow control devices are built into the valve spool, and each flow control is effective to control the rate of fluid flow both to and from one port of a double action cylinder.

COMPARISON WITH THE PRIOR ART

The present invention provides a four-way valve in which a single flow control is utilized to control the rate of fluid flow to the port of a double action cylinder that lifts a gravity load, and to control the rate of fluid flow from the same port of the double action cylinder to achieve precise control of lowering of the gravity load.

Since raising a gravity load requires pressurized fluid from the pump but lowering requires only the fluid and not pressure to provide work, raising a gravity load is commonly called a positive load, and lowering the load is called a negative load.

Of the aforementioned patents, Buszich, U.S. Pat. Nos. 3,744,517, and 3,858,393, Masuda, Walters, Wilke, and Paul are the only ones that have provided both control of the rate of fluid flow to a fluid motor and control of the rate of fluid flow from the fluid motor. Thus the present invention is obviously an advancement in the art over the others; and so no further discussion of them is necessary.

Budzich, in U.S. Pat. No. 3,744,517 and divisional U.S. Pat. No. 3,858,393, utilizes two separate flow controls. One flow control is located between the pressure inlet port and the valve spool and controls the rate of fluid flow to both work ports; and the other flow control is located between a pair of return channels and the return port and controls the rate of fluid flow from both work ports. Thus the principal advancement of the present invention over these patents of Budzich is in the utilization of a single flow control to handle both positive and negative loads.

Masuda's flow control unit, that functions as a bypass valve for the pump as well as controlling the rate of fluid flow both to and from a fluid motor, controls the throttling of fluid flow from the fluid motor as a function of the pressure differential across an inlet throttling orifice. Thus a heavy gravity load could lower faster than the rate of fluid flow being supplied to the other port of the fluid motor; and his inlet sensed flow control would not correct the situation. Thus the present invention, which senses inlet throttling for the control of positive or raising loads and which senses outlet throttling for the control of negative or lowering loads, is an advancement in the art over Masuda.

Walters' flow control unit also, as with Masuda, controls flow both to and from a fluid motor with a single flow control that is actuated by inlet sensing; so that no definite control is provided for negative loads by Walters' flow control. In contrast, the present invention utilizes inlet sensing for the control of positive loads and outlet sensing for the control of negative loads.

Wilke's invention includes two flow control units which are located in the valve spool and which each control the rate of fluid flow both to and from one port of a fluid motor. Wilke's device presents an advancement in the art as to function; but it has the inherent limitation of low maximum flow rate for its size or high energy loss because of the location of the flow control units within the valve spool. In contrast, the present invention utilizes a flow control plunger in the body that provides maximum flow capacity with minimum energy loss.

Paul's FIG. 5 configuration does not include any provision for the control of negative loads. His FIG. 4 configuration controls return flow as a function of inlet sensing; so his flow device does not control the rate of fluid flow returning from a fluid motor as a proportional function of valve spool movement where heavy gravity loads are encountered; although his device does function as a counterbalance valve to prevent a runaway condition from a negative load. Thus neither of these two of Paul's embodiments achieve the proportional control of both positive and negative loads, as is achieved by the present invention.

Paul's FIG. 3 configuration is a three-way directional control valve that utilizes a single flow control device to achieve proportional control of the rate of fluid flow both to and from a fluid motor; and so it is the most similar, of all of the prior art, to the present invention in which a four-way directional control valve utilizes a single flow control to control the rate of fluid flow to the lift port of a hydraulic cylinder and to control the rate of fluid flow from this same cylinder port.

The principal advantages of the present invention, in its basic form without added features, over that of Paul's FIG. 3 embodiment, include simplicity and reduction of size. The flow control plunger of the present invention is less than half as long as the valve body whereas the flow control of Paul's FIG. 3 embodiment extends through the entire length of the valve body. Thus the present invention greatly reduces the cost of manufacturing, decreases straightness and sticking problems, allows a closer diametral fit of the plunger for better control of leakage, decreases the mass of the spring-mass system for better dynamic stability, and decreases the overall package size to facilitate installation into a machine.

In both embodiments of the present invention, these advantages in cost, size, and performance are achieved by the use of a single fluid channel or service channel which interconnects the valve spool and flow control, rather than the more complex configuration of Paul which uses two fluid channels to interconnect the valve spool and flow control.

The basic configuration of the present invention and the service channel thereof, besides providing design and functional advantages over all of the aforementioned art, is also ideally suited for the incorporation of other desirable features, as will be discussed hereafter.

ADVANCEMENTS MADE BY THE PRESENT INVENTION

In addition to the aforementioned advancements in the art, both in design and function, as compared to prior art, the use of the single interconnecting channel or service channel and the arrangement of the other channels permit the present invention to be embodied into a compact four-way valve using a single flow control to control both flow to and from a single cylinder port in response to both inlet and outlet sensing.

The present invention, which in the simplest form may be a three-way valve although described herein as a four-way valve, is also readily adaptable to provide additional functions such as regeneration, float, inactivation of the flow control in float, load holding, load check, load lock, and anticavitation control, and all of these additional functions are shown and described in conjunction with the preferred embodiments.

SUMMARY OF THE INVENTION

The Basic Configuration

A fluid flow controlling device is provided which comprises a directional control valve and a flow control. The directional control valve comprises a body having a pressure inlet channel, a work port channel, a service channel, and return port means. A spool bore intercepts the pressure inlet channel, the service channel, and the return port means.

A valve spool is slidably fitted into the spool bore and is movable to a first operating position wherein an inlet throttling orifice or first fluid flow path is established and selectively sized from the pressure inlet channel to the service channel, and to a second operating position wherein an outlet throttling orifice or second fluid flow path is established and selectively sized between the service channel and the return port means.

A plunger bore intercepts and interconnects the service channel and the work port channel. A flow control plunger is slidably fitted into the plunger bore and is movable to free-flow and flow restricting positions by fluid pressures applied to first and second fluid responsive operators which comprise respective projected ends of the flow control plunger.

The rate of fluid flow, from the pressure inlet channel, through the service channel, and out through the work port channel, is controlled to be proportional to the cross-sectional area of the first fluid flow path by the application of the fluid pressure in the pressure inlet channel to a first one of the fluid responsive operators, by the application of the fluid pressure in the service channel to the second fluid responsive operator, and by a spring that assists the fluid pressure applied to the second fluid responsive operator.

The spring load divided by the projected area of one fluid responsive operator determines the pressure drop through the first fluid flow path at which the flow control plunger is actuated to a flow restricting position; and so the rate of fluid flow through the first fluid flow path is automatically controlled to correspond to this spring determined differential pressure.

In like manner, the rate of fluid flow, from the work port channel, through the service channel, and into the return port means, is controlled to be proportional to the cross-sectional area of the second fluid flow path by the application of the fluid pressure in the service channel to one of the fluid responsive operators, and by the application of the fluid pressure in the return port means to the other fluid responsive operator.

A FIRST PREFERRED EMBODIMENT

In a first preferred embodiment, the flow control, in addition to controlling the rate of fluid flow both to and from a fluid motor for the control of positive and negative loads, also functions as: a load check to prevent reverse flow from the work port channel to the pressure inlet channel, a load lock to prevent lowering of a load when the pump is not running, a load holding device to decrease valve spool leakage and thereby to further minimize load lowering by leakage, and an anticavitation device to prevent lowering of a load faster than fluid can be delivered to the volume increasing side of the hydraulic cylinder.

A SECOND PREFERRED EMBODIMENT

In a second preferred embodiment, the directional control valve includes low pressure regeneration of fluid from one work port channel to the other work port channel, and a float position wherein both work port channels are communicated with the return port means. In the float position, the flow control is inactivated to prevent any interference with free floating of the fluid motor.

OBJECTS OF THE INVENTION

It is a first object of the invention to provide a fluid flow controlling device in which a single flow control plunger cooperates with the valve spool of a directional control valve to achieve control of the fluid flow rate both to and from a fluid motor in proportion to the movement of the valve spool and independent both of the supply pressure thereto and the load actuating pressure of a fluid motor.

It is a second object of the invention to provide a fluid flow controlling device that incorporates a flow control interposed in series with the valve spool and intermediate of the valve spool and the work port so that the aforementioned control of both fluid flow rates can be achieved.

It is a third object of the invention to provide a fluid flow controlling device in which a maximum flow rate is provided for a given package size and in which flow energy losses are minimized.

It is a fourth object of the invention to provide a flow control that achieves the aforementioned control of both fluid flow rates with a flow control plunger of minimum length in a plunger bore of minimum length to decrease package size, to minimize cost, to minimize machining problems, to facilitate closely fitting the plunger to the bore, and to minimize the mass and dynamic instability problems of the plunger.

It is a fifth object of the invention to provide a fluid flow controlling device of the class herein described in which the general configuration of the directional control valve and flow control thereof are adaptable to the incorporation of low pressure regeneration.

It is a sixth object of the invention to provide a float position in the control valve.

It is a seventh object of the invention to inactivate the flow control when the control valve is in the float position.

It is an eighth object of the invention to provide a flow control of the type herein described in which the flow control functions as a load check.

It is a ninth object of the invention to provide a flow control of the type described herein in which the flow control functions as a load lock to prevent lowering of the load except when the pump is running.

It is a tenth object of the invention to provide a flow control in which the flow control serves as a load holding device during stand-by.

It is an eleventh object of the invention to provide a flow control of the type described herein in which the flow control functions to prevent cavitation when rapidly lowering a gravity load.

It is a twelfth object of the invention to provide a logic system for the utilization of the fluid flow controlling device in load responsive hydraulic systems.

These and other objectives will be apparent to the reader from the detailed description.

DETAILED DESCRIPTION OF A FIRST PREFERRED EMBODIMENT

Figure 1:
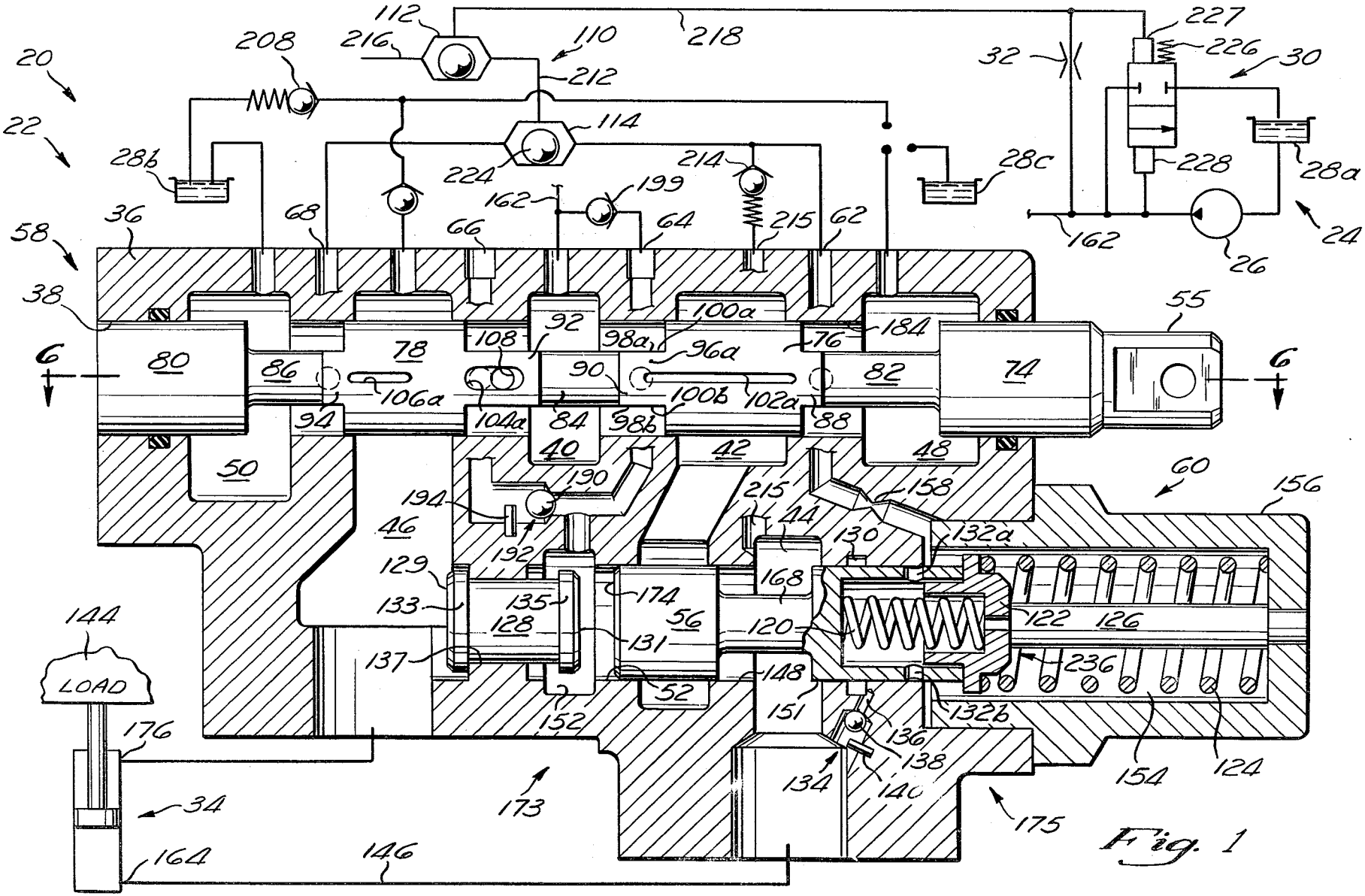
FIG. 1 is a cross-sectional drawing of a first preferred embodiment of the invention with the valve spool thereof in the stand-by position, and with the other components of the system depicted schematically.

Referring now to FIG. 1, load responsive hydraulic system 20 includes fluid flow controlling device 22, source of pressurized fluid 24 which comprises pump 26 and sump 28*a*, by-pass valve 30, signal supply orifice 32, and fluid motor or hydraulic cylinder 34.

Fluid flow controlling device 22 includes body 36. Body 36 includes spool bore 38, pressure inlet channel 40, service channel 42, first work port channel 44, and second work port channel 46, all of which intercept spool bore 38 except for first work port channel 44. Body 36 also includes a return port means which comprises both a first return channel or branch channel 48 and a second return channel 50 intercepting spool bore 38. Body 36 further includes plunger bore 52 that intercepts and interconnects service channel 42 and first work port channel 44.

Figure 2:
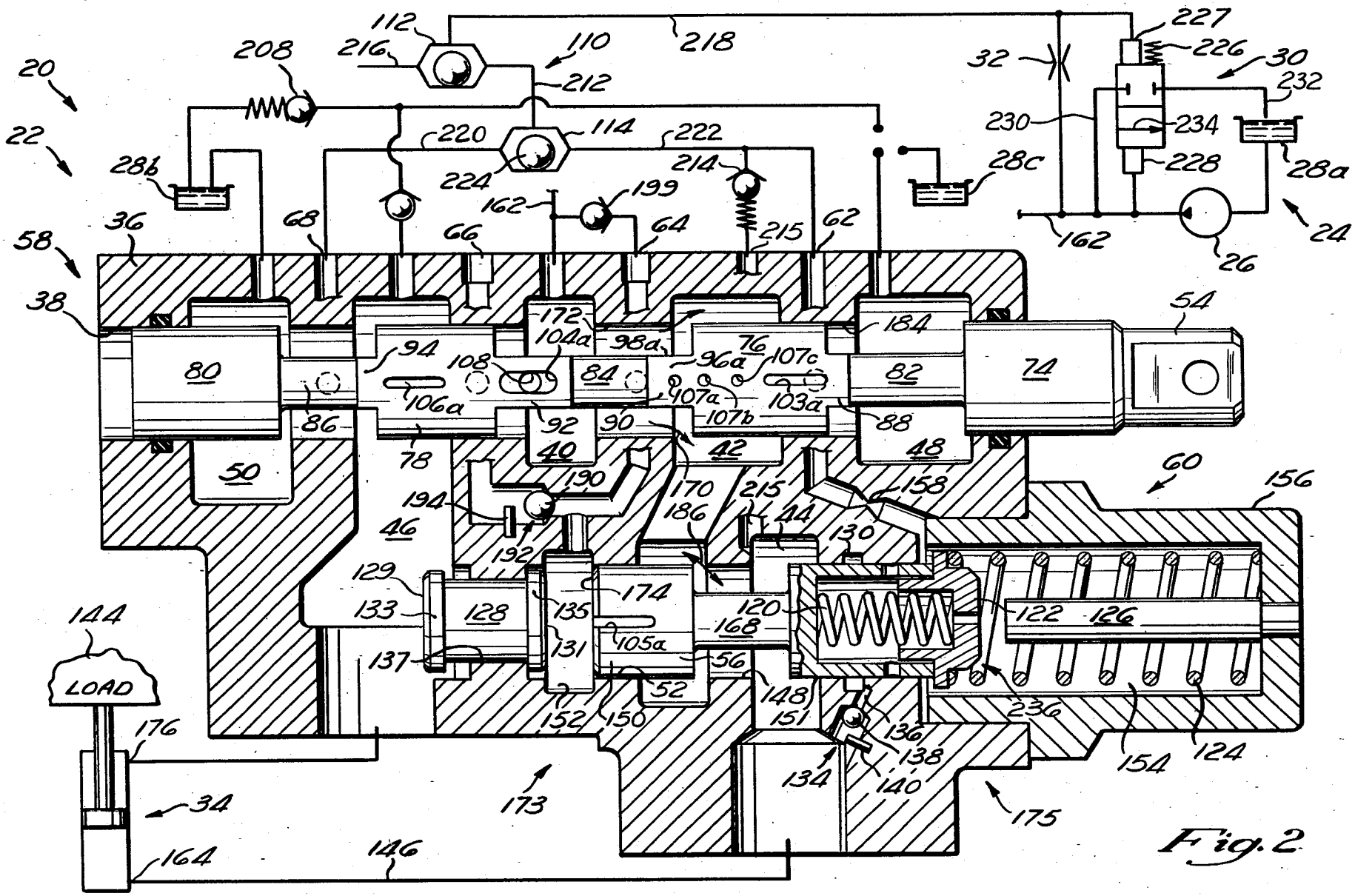
FIG. 2 is a cross-sectional and schematic drawing as FIG. 1 but with the valve spool moved to the load raising position and also illustrating replacement of the functions of longitudinally extending groove 102*a* of FIG. 1 by shorter groove 103*a* and plunger groove 105*a;*
Figure 3:
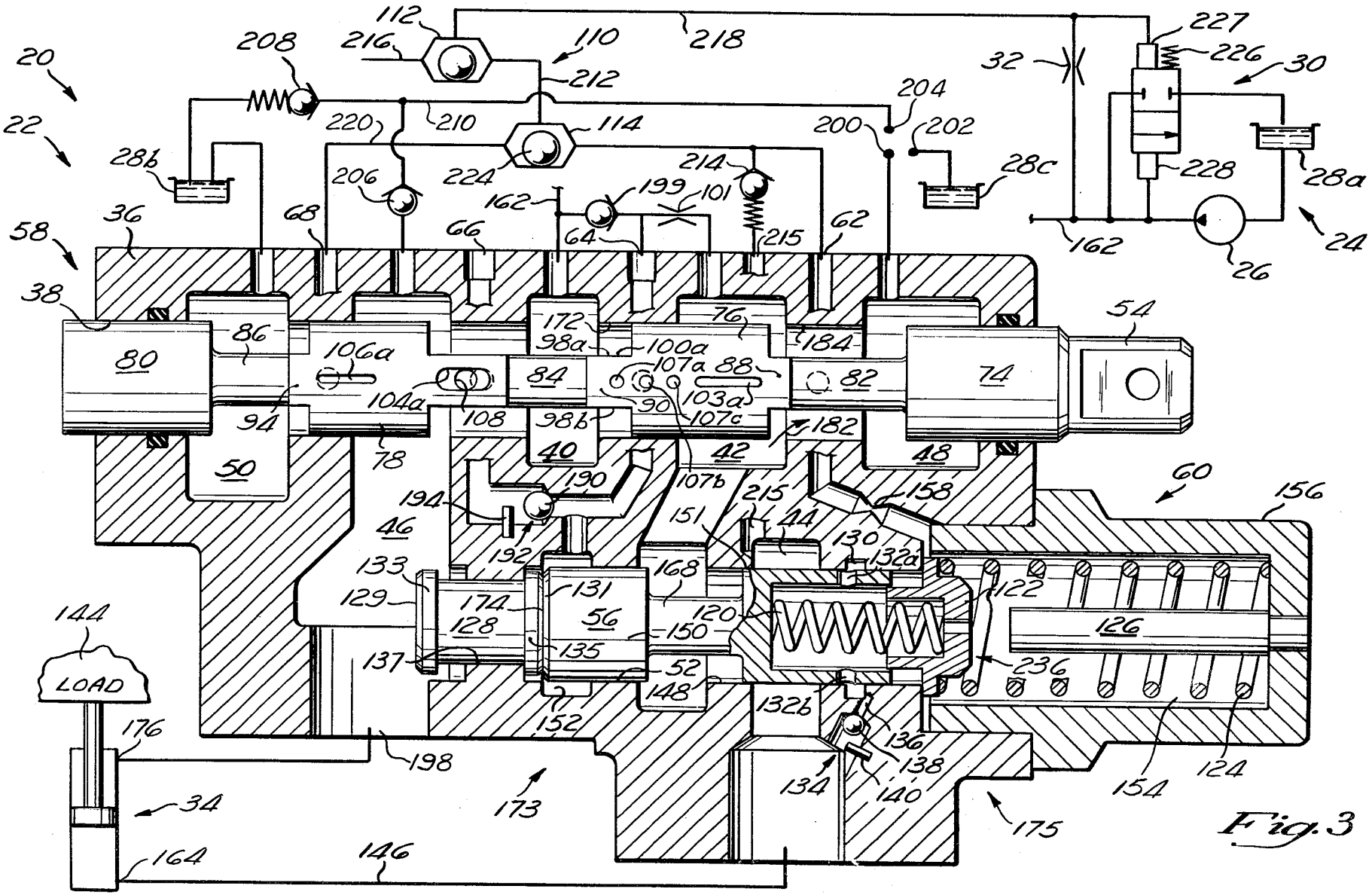
FIG. 3 is a cross-sectional and schematic drawing as of FIG. 1 but with the valve spool moved to the load lowering position and with the flow control plunger preventing lowering of the load and also illustrating replacement of the functions of longitudinally extending groove 102*a* of FIG. 1 by shorter groove 103*a* and orifice or fluid restrictor 101.

Fluid flow controlling device 22 includes valve spool 55 of FIG. 1, or valve spool 54 of FIGS. 2 and 3, that is slidably fitted into spool bore 38, and flow control plunger 56 that is slidably fitted into plunger bore 52.

Fluid flow controlling device 22 generally comprises directional control valve 58 that includes body 36, vlave spool 55, and work port channels 44 and 46; and fluid flow controlling device 22 further comprises flow controlling means 60 that is interposed between valve spool 55 and first work port channel 44 and that includes flow control plunger 56.

Figure 6:
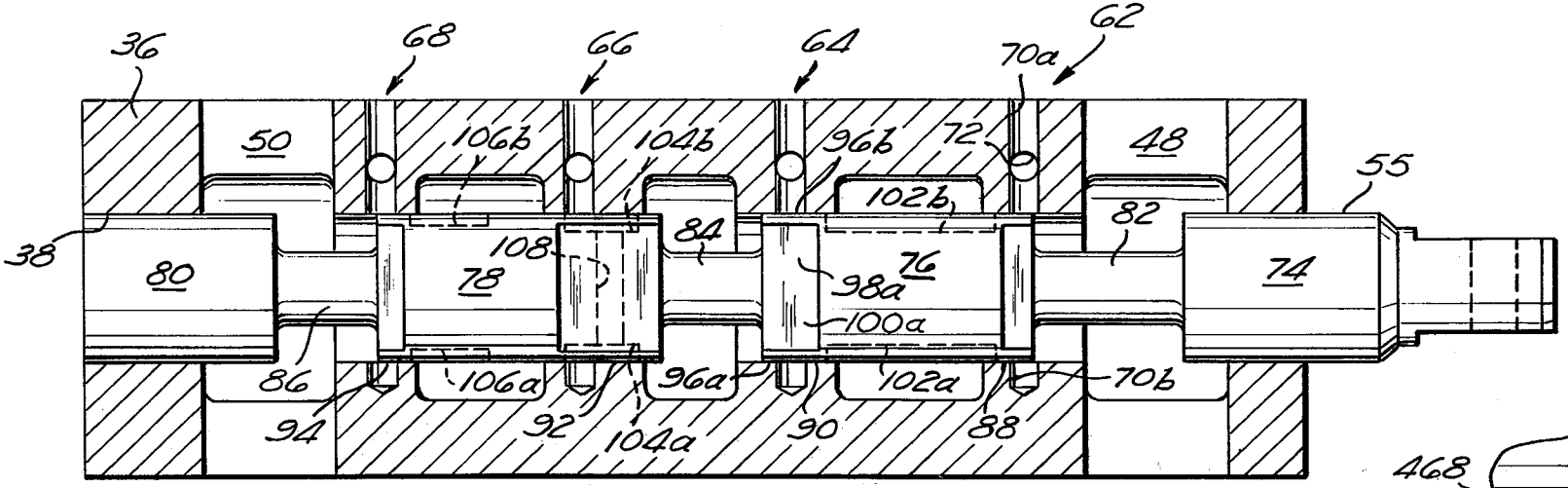
FIG. 6 is a cross-sectional view of FIG. 1, taking substantially as shown by section line 6—6 in FIG. 1.

Referring now to FIGS. 1 and 6, body 36 includes signal passage means 62, 64, 66, and 68, all of which are generally depicted in FIG. 1 and all of which are shown in greater detail in FIG. 6. Each of the signal passage means, 62, 64, 66, and 68 comprise three similar portions; so that a description of one will suffice for all. For instance, signal passage means 62 comprises intercepting portions 70*a* and 70*b* which intercept spool bore 38 substantially concentriacally and orthogonally thereto and which comprise portions of a single hole which are on diametrically opposite sides of spool bore 38. Signal passage means 62 also comprises vertical portion 72 which intercepts intercepting portion 70*a*.

Referring again to FIGS. 1 and 6, valve spool or movable valving element means 55 comprises cylindrical land portions 74, 76, 78, and 80 which are spaced from each other by reduced cross-section portions 82, 84, and 86 respectively. Valve spool 55 also includes tang means 88, 90, 92, and 94, which are formed on respective ends of cylindrical land portions 76 and 78 by milling diametrically opposite notches on portions of the cylindrical lands 76 and 78. Because of the similarity of tang means 88, 90, 92, and 94 to each other except for the relative lengths thereof, a description of one will suffice for all.

Tang means 90 comprises oppositely disposed cylindrical surfaces 96*a* and 96*b* and flow notch means or diametrically opposed notches 98*a* and 98*b* which include tang side faces 100*a* and 100*b*.

Referring again to FIGS. 1 and 6, valve spool 55 includes first longitudinally extending passage means in cylindrical land portion 76 which comprises a first pair of diametrically opposed and longitudinally extending grooves 102a and 102b, second longitudinal extending passage means in cylindrical land portion 78 which comprises a second pair of diametrically opposed and longitudinally extending grooves 104a and 104b, and third longitudinal extending passage means which comprises a third pair of diametrically opposed and longitudinally extending grooves 106a and 106b. Valve spool 55 further includes radial pressure balancing hole 108 that extends orthogonally through valve spool 55 interconnecting grooves 104a and 104b and that serves to provide radial pressure balance between grooves 104a and 104b.

Referring now to FIGS. 1–3, optionally, the functions of longitudinally extending groove 102a of FIG. 1 may be replaced by shorter grooves 103a and plunger groove 105a of FIG. 2 in which plunger groove 105a functions as a plunger positioned passage means, or by shorter groove 103a and orifice or fluid restrictor 101 of FIG. 3, as will be described subsequently.

Referring again to FIG. 1, load responsive hydraulic system 20 further comprises control logic means 110 which includes three-port shuttle valve 112 and three-port shuttle valve 114. Shuttle valves 112 and 114 are preferably included in body 36 but are schematically represented herein for clarity.

Figure 4:
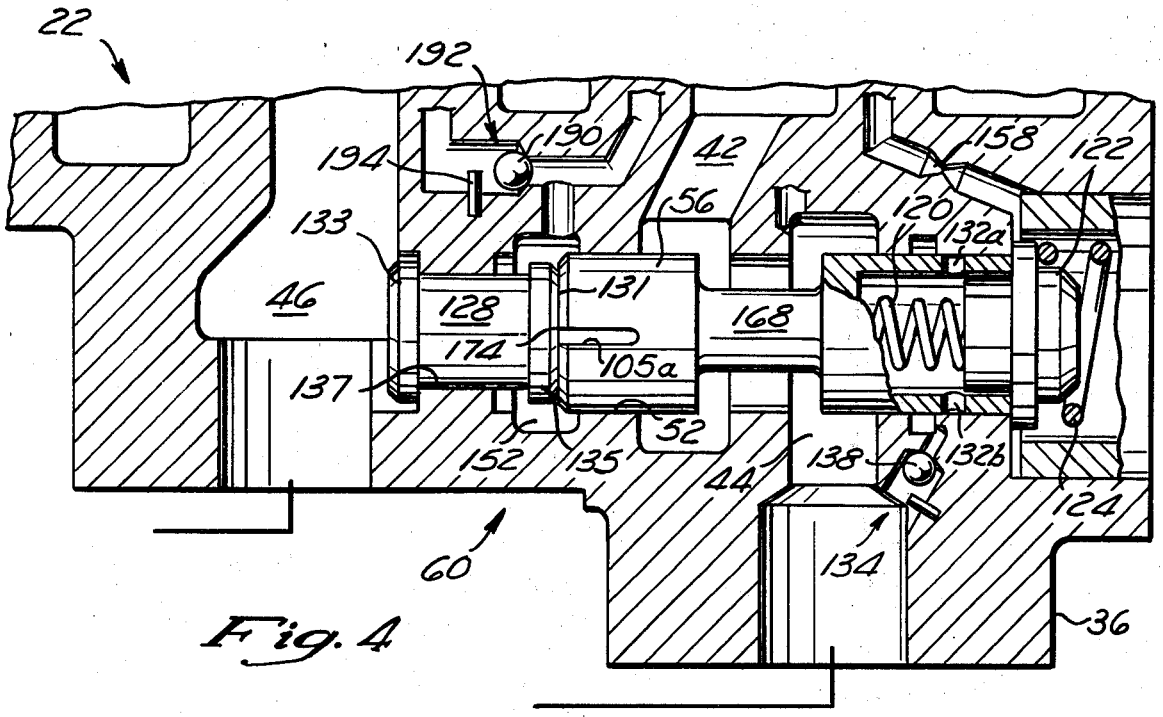
FIG. 4 is a partial cross-sectional drawing of the directional control valve of FIG. 1, showing the flow control plunger in the free-flow position.

Referring now to FIGS. 1–5, flow controlling means 60 is illustrated in five different positions in these figures. Referring now to FIG. 4 for a detailed description of the costruction of flow controlling means 60, in addition to bore 52 and flow control plunger 56 which is slidably inserted into bore 52, flow controlling means 60 comprises first resilient bias means or spring 120, spring adapter 122, second resilient bias means or spring 124, and stop rod 126 which is shown in FIG. 1. Spring 120 has a lower load gradient and a lower assembled load than spring 124; so that, when flow control plunger 56 is actuated against springs 120 and 124, plunger 56 first compresses spring 120 until flow control plunger 56 abuts spring adapter 122 and then flow control plunger 56 compresses spring 124 until spring adapter 122 abuts stop rod 126.

Referring now to FIGS. 1 and 2, flow controlling means 60 additionally comprises shuttle piston 128 having ends 129 and 131 and collars 133 and 135, and being slidably fitted into bore 137 of body 36. Shuttle piston 128 is shown in its extreme rightward position in FIG. 1 as determined by collar or stop means 133 and in its extreme leftward position in FIG. 2 as determined by collar or stop means 135. Bore 137 is preferably coaxial with bore 52; and end 131 of piston 128 is adapted to mechanically engage end 174 of flow control plunger 56 as shown in FIGS. 3 and 4.

Referring now to FIG. 3, flow controlling means 60 further includes circumferential groove 130, parts or holes 132a and 132b, and check valve 134. Check valve 134 comprises seat hole 136, ball 138, and stop 140.

Referring again to FIGS. 1–5, the aforementioned positions of flow control plunger 56 include a free-flow position as illustrated in FIG. 4, a flow throttling position as shown in FIG. 2 which is used to control both raising and lowering flow for fluid motor 34, a first flow blocking position as shown in FIG. 3 which provides the load check function, an anticavitation throttling position as shown in FIG. 5 which prevents the lowering of a load at a speed greater than that at which pump 26 can supply fluid to second work port channel 46, and a second flow blocking position as shown in FIG. 1 which provides a load holding function when the system is in stand-by operation. The first flow blocking position of FIG. 3 also provides a load lock function to prevent the lowering of load 144 of fluid motor 34 when pump 26 is not operating.

Referring now to FIGS. 1–3, in FIG. 1, valve spool 55 is in a stand-by position, in FIG. 2, valve spool 54 is in the raising position, and in FIG. 3, valve spool 54 is in the lowering position. These three valve spool positions, and the aforementioned flow control plunger positions, will subsequently be used to describe the aforementioned six operating functions of flow controlling means 60.

LOAD HOLDING FUNCTION DURING STAND-BY

Referring again to FIG. 1, with valve spool 55 in the stand-by position as shown, tang means 88 is ineffective to block fluid communication between signal passage means 62 and first return channel 48, signal passage means 64 is isolated from pressure inlet channel 40 by tang means 90 but is communicated to service channel 42 by longitudinally extending grooves 102a of FIG. 1, or by plunger groove 105a of FIG. 2, or by restrictor 101 of FIG. 3, signal passage means 66 is isolated from both pressure inlet channel 40 and second work port channel 46 by tang means 92, and signal passage means 68 is communicated to second return channel 50 because of the incomplete blocking of signal passage means 68 by tang means 94.

With valve spool 55 in the stand-by position as shown, pressure inlet channel 40 is isolated from both service channel 42 and second work port channel 46, service channel 42 is isolated from first return channel 48, and second work port channel 46 is isolated from second return channel 50.

Load 144 on fluid motor 34 applies fluid pressure to first work port channel 44 via conduit 146; and, if plunger 56 should happen to be in the flow blocking position that is illustrated in FIG. 3, fluid leakage between bore land portion 148 of plunger bore 52 and cylindrical land portion 151 of plunger 56 results in pressurizing of service channel 42. This pressurization of service channel 42 results in the pressurization of chamber 152 by fluid flow through groove 102a of FIG. 1, or through groove 105a of FIG. 2, or through restrictor 101 of FIG. 3, thereby moving plunger 56 to the position shown in FIG. 1 in opposition to resilient bias means or spring 120 and resilient bias means or spring 124. At this time there is no fluid pressure in spring chamber 154 of spring cap 156 because of the intercommunication of chamber 154 with first return channel 48 via signal passage means 62 and orifice 158 therein. Therefore, during the stand-by condition, load 144 of fluid motor 34 is held by plunger 56 of flow controlling means 60 in addition to being held by valve spool 55. The advantage is that a short spool, plunger 56, utilizing a long sealing land, holds load 144 at a low rate of fluid leakage in addition to the load holding leakage control of valve spool 55.

In stand-by operation, as described above, and with flow control plunger 56 in the position shown in FIG. 1, flow control plunger 56 abuts spring adapter 122 and spring adater 122 abuts stop rod 126.

FLOW CONTROL FUNCTION FOR RAISING

Referring now to FIG. 2, with valve spool 54 moved to a first operating position, as shown, and with plunger 56 in the free-flow position as shown in FIG. 4, pressurized fluid from pump 26 and conduit 162 is applied to motor port 164 of fluid motor 34 via pressure inlet channel 40, reduced cross-section portion 84 of valve spool 54, service channel 42, reduced cross-section portion 168 of flow control plunger 56, and first work port channel 44. At this time, a first fluid flow path or throttling orifice 170 is established and selectively sized between pressure inlet channel 40 and service channel 42 by cooperating parts of cylindrical land portion 76 of valve spool 54 and bore portion 172 of spool bore 38.

Further, at this time, pressurized fluid at substantially the fluid pressure of pump 26 is applied to chamber 152 via pressure inlet channel 40 and signal passage means 64. Also, the fluid pressure in service channel 42 is applied to spring chamber 154 via longitudinally extending groove 102*a* of FIG. 1 or shorter groove 103*a* of FIGS. 2 and 3 and via signal passage means 62; so that plunger 56 is moved to the right against the opposition of spring 124 by the difference in fluid pressure between that in pressure inlet channel 40 and service channel 42. That is, plunger 56 is actuated by the difference betwen the fluid pressures in channels 40 and 42 in accordance with the rate of fluid flow through first fluid flow path 170 and the selective sizing of first fluid flow path or throttling orifice 170 as determined by the selective positioning of valve spool 54.

It should be understood that spring 120 has a lower assembled load and a lower load gradient than that of spring 124; and the flow controlling function depends upon the spring load of spring 124. Further it should be understood that spring 124 is effective to move plunger 56 to the left of the position shown in FIG. 2 to the point wherein spring adapter 122 contacts body 36 as shown in FIG. 4; and spring 120 is effective to move plunger 56 into chamber 152 to the point wherein projected end 174 of plunger 56 abuts the end 131 of piston 128 as shown in FIG. 3.

Also, at this time, piston 128 will be in its extreme leftward position, as shown in FIG. 2; because the pressure of pump 26, as applied to chamber 152 will greatly exceed the pressure of fluid that is exhausting from motor port 176 of fluid motor 34 to sump 28*b* via second work port channel 46 and second return channel 50.

If fluid restrictor 101 of FIG. 3 is included, some fluid will flow from pressure inlet channel 40 to service channel 42 via signal passage means 64 and restrictor 101 at a low rate when valve spool 54 is in the position shown in FIG. 2; but the above-described operation will not be changed because the fluid conductance of the restrictor 101 is made to be small in comparison to the conductance of the flow path around reduced cross-section portion 84; and so the fluid pressure in signal passage means 64 and in chamber 152 will correspond to that of the fluid pressure in pressure inlet channel 40.

In like manner, if groove 105*a* is included in plunger 56 as shown in FIG. 2, then during the raising operation of FIG. 2, both valve spool 54 and plunger 56 will be in the positions as shown in FIG. 2, groove 105*a* will communicate service channel 42 with chamber 152 by limited conductance, signal passage means 64 will communicate pressure inlet channel 40 to chamber 152 by a much greater conductance, and the fluid pressure in chamber 152 will substantially equal the fluid pressure in pressure inlet channel 40.

OPENING FOR RAISING FUNCTION FROM LOAD HOLDING FUNCTION

Referring to FIGS. 1 and 2, if flow control plunger 56 is in the flow blocking position of FIG. 1 which provides the load holding function, then movement of valve spool 54 to the raising position or first operating position of FIG. 2 is effective to intercommunicate chamber 152 with inlet channel 40 and with service channel 42, and to intercommunicate service channel 42 with chamber 154 via groove 103*a;* so that equal fluid pressures are applied to chambers 152 and 154; and therefore spring 124 is effective to move plunger 56 toward the freeflow position of FIG. 4 to open flow controlling means 60 for the load raising function.

LOAD CHECK FUNCTION FOR RAISING

Referring again to FIG. 2, during the raising of a load, if the load actuating pressure of load 144, as exerted in first work port channel 44, becomes larger than the fluid pressure of pump 26 in pressure inlet channel 40, the fluid pressure in service channel 42 becomes equal to or greater than the fluid pressure in pressure inlet channel 40 and plunger 56 is moved to the load check or flow blocking position of FIG. 3 by the force exerted by springs 120 and 124. That is, plunger 56 and spring adapter 122 are moved to the point wherein spring adapter 122 abuts body 36 by the force of spring 124, and plunger 56 is moved by the force of spring 120 to the point wherein projected end 174 of plunger 56 moves to abut end 131 of piston 128. Thus, lowering of load 144, when valve spool 54 is in the raising position of FIG. 2, is prevented.

OPENING FOR RAISING FUNCTION FROM LOAD CHECK FUNCTION

Referring to FIGS. 2 and 3, if valve spool 54 is moved to the raising position as shown in FIG. 2, and if plunger 56 is in the load check position as shown in FIG. 3, then initially there will not be a pressure drop across throttling orifice 170 from channel 40 to channel 42; so the fluid pressure applied to chambers 152 and 154 by signal passage means 64 and signal passage 62, respectively, will be identical; and plunger 56 will not be moved to the right to open service channel 42 to first work port channel 44. However, as shown in FIG. 3, groove 130, holes 132*a* and 132*b*, and check valve or one-way flow valve 134 provide fluid communication between chamber 154 and first work port channel 44 to provide a pressure reduction passage; so that this communication between chamber 154 and first work port channel 44 cooperates with orifice or fluid restrictor 158 to provide pressure reduction means which reduces the fluid pressure in chamber 154 below that of service channel 42; whereby plunger 56 is moved to the right against the opposition of spring 120 and service channel 42 is communicated to work port channel 44 by reduced cross-section portion 168.

FLOW CONTROL FUNCTION FOR LOWERING

Referring now to FIG. 3, lowering with power is achieved by moving valve spool 54 to the position shown in FIG. 3. At this time, flow control plunger 56 usually will be in the position shown in FIG. 1 by virtue of leakage from first work port channel 44 to service channel 42 via bore land portion 148. When valve spool 54 is moved to the position shown in FIG. 3, signal passage means 64, and groove 102*a* of FIG. 1, or groove 105*a* of plunger 56 of FIG. 2, or restrictor 101 of FIG. 3 communicate chamber 152 with service channel 42, and second fluid flow path 182 communicates service channel 42 to return channel 48; so that equal fluid pressures will be applied to fluid responsive operators 173 and 175; and then spring 120 will move plunger 56 toward the free-flow position of FIG. 4 to establish lowering flow. Then fluid will flow from motor port 164 to first return channel 48 via reduced cross-section portion 168, service channel 42, and reduced cross-section portion 82; and flow control plunger 56 will be moved to a flow throttling position, as shown in FIG. 2, by fluid pressure in service channel 42 being applied to chamber 152 via longitudinally extending groove 102*a*, or via plunger groove 105*a*, or via restrictor 101, and by the fluid pressure in return channel 48 being applied to chamber 154 via signal passage means 62.

The magnitude of the fluid pressure in service channel 42 will be determined by the selective sizing of second fluid flow path or throttling orifice 182 that is selectively sized between cooperating parts of cylindrical land portion 76 and bore land portion 184, and by the rate of fluid flow through second fluid flow path 182.

That is, the rate of fluid flow from fluid motor 34 to first return channel 48 will be proportionate to the cross-sectional flow area of second fluid flow path 182 and the spring load of spring 124, plunger 56 being moved to the right to the throttling position thereof as shown in FIG. 2, and the rate of fluid flow being automatically controlled by throttling orifice 186 of FIG. 2.

OPENING FOR LOWERING FUNCTION FROM LOAD CHECK FUNCTION

Referring again to FIG. 3, if, when the lowering function is initiated, flow control plunger 56 is in the load check position as shown in FIG. 3, then the application of pressurized fluid from pump 26 to second work port channel 46 via pressure inlet channel 40 and reduced cross-section portion 84 of valve spool 54 forces piston 128 to its extreme rightward position, moving plunger 56 to the free-flow position thereof as shown in FIG. 4, thereby initiating lowering flow.

This rightward movement of piston 128 is unopposed by fluid pressure in chamber 154; because, at this time, chamber 154 is communicated to first return channel 48. Thus this rightward movement of plunger 56 also is unopposed by fluid pressure in chamber 152 since plunger 56 is free to move rightwardly except for the force of spring 120.

LOWERING WITH INSUFFICIENT PUMP FLOW

Figure 5:
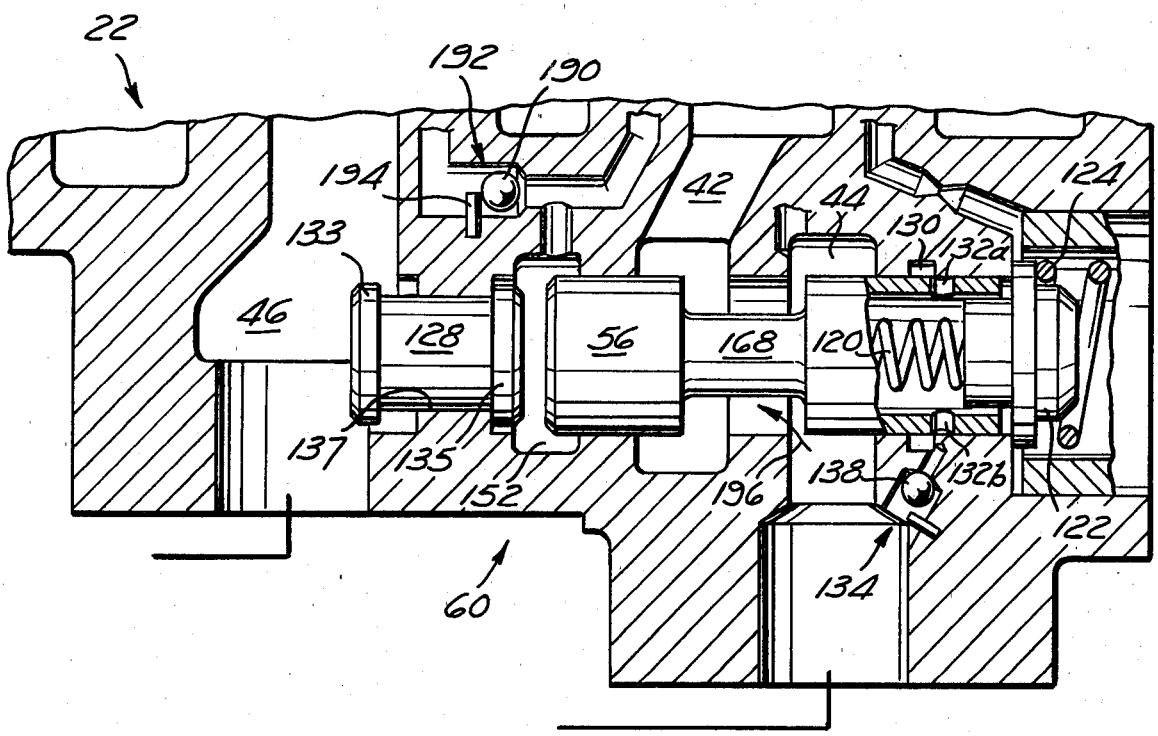
FIG. 5 is a partial cross-sectional drawing of the directional control valve of FIG. 1, showing the flow control in the anticavitation throttling position.

Referring now to FIGS. 3 and 5, if pump 26 is unable to furnish sufficient flow to second work port channel 46 and to motor port 176 of fluid motor 34 to prevent cavitation in second work port channel 46 and fluid motor 34, ball 190 of check valve 192 will move against stop 194 as shown in FIG. 5; and the fluid pressure in chamber 152, which during initial lowering has been at the same pressure as service channel 42 by virtue of groove 102*a*, or groove 105*a* of plunger 56, or restrictor 101 communicating with signal passage means 64, will be reduced by fluid flow from chamber 152 to second work port channel 46 via check valve 192 and lonitudinally extending groove 104*a*.

The fluid conductance of groove 104*a* is made to be greatly in excess of the fluid conductance of groove 102*a*, or groove 105*a*, or orifice 101; so that groove 104*a* is effective to lower the fluid pressure in chamber 152 even though groove 102*a*, groove 105*a*, or restrictor 101 furnishes fluid from service channel 42 to chamber 152.

This reduction of fluid pressure in chamber 152 allows spring 120 to move plunger 56 to the left to the anticavitation throttling position or flow throttling position as shown in FIG. 5 wherein throttling flow path 196 controls the rate of fluid flow of fluid being exhausted from port 164 of fluid motor 34 to a value at which pump 26 can maintain a low pressure, perhaps 20 psi, in second work port channel 46. The exact magnitude of fluid pressure which will be maintained in second work port channel 46 will depend upon the load of spring 120 and the projected area of piston 128; so that this pressure which is maintained in second work port channel 46 can be selectively determined by design selection of these two parameters.

LOAD LOCK FUNCTION IN A FOUR-WAY VALVE

Referring now to FIG. 3, if there is an attempt to lower load 144 of fluid motor 34 by movement of valve spool 54 to the position shown in FIG. 3 when pump 26 is not delivering fluid to fluid flow controlling device 22, any fluid pressure in chamber 152 will be exhausted to second work port channel 46 and port 176 of fluid motor 34 by check valve 192 and longitudinally extending groove 104*a* as load 144 attempts to exhaust fluid from port 164 of fluid motor 34. Then, plunger 56 will be moved to the flow blocking position of FIG. 3 by spring 120, thereby providing a load lock function.

FUNCTIONING AS A THREE-WAY VALVE

Referring again to FIG. 3, if fluid flow controlling device 22 is connected to fluid motor or hydraulic cylinder 34 only at port 164, and work port 198 of second work port channel 46 is plugged, then device 22 will function as previously described for all of the functions except for two.

One of these functions is the anticavitation throttling function which is not required because no pump fluid is delivered to fluid motor 34 during lowering.

The other of these functions is the load lock function. Lowering of load 144 will not reduce the fluid pressure in second work port channel 46; but the inclusion of check valve 199 is effective to reduce the fluid pressure in chamber 152 by fluid flow to sump 28*a* via pressure inlet channel 40 and pump 26 when pump 26 is not operating; so that spring 120 is able to move plunger 56 to the flow blocking position of FIG. 3 to achieve the load lock function when pump 26 is not operating.

However, the inclusion of check valve 199 in systems having a stand-by pressure in pressure inlet channel 40 that is lower than the fluid pressure that is required in service channel 42 to compress spring 124 for the load holding function of FIG. 1, will cause lowering of the load 144 by leakage through restrictor 101 of FIG. 3, groove 105*a* of FIG. 2, or groove 102*a* of FIG. 1, and through check valve 199 to pump 26 of FIGS. 1–3.

REGENERATIVE AND POWER LOWERING

Referring now to FIG. 3, if connection points 200 and 202 are interconnected, fluid exhausting from fluid motor 34 via conduit 146 will be discharged into sump 28*c* in the conventional manner. However, if instead, connection points 200 and 204 are interconnected, then fluid being discharged from fluid motor 34 via conduit 146 will be transferred by regenerative flow into second work port channel 46 via regenerative check valve 206; and cavitation in second work port channel 46 and port 176 of fluid motor 34 will be prevented. To prevent excessive pressure being developed in port 176 of fluid motor 34 during this regenerative function, low pressure regenerative relief valve 208 interconnects conduit 210 and sump 28*b* to limit the fluid pressure in conduit 210 to a suitable value, say 100 psi.

With connection points 200 and 204 connected, channel 48 functions as a transfer or regenerative channel rather than a return channel; so the return port means of fluid flow controlling device 22 comprises transfer channel 48 and return channel 50.

CONTROL LOGIC MEANS

Referring now to FIG. 2, control logic means 110 of FIGS. 1–3 comprises, in addition to three-port shuttle valves 112 and 114, control port 212 which is pictured as a conduit, signal passage means 62, signal passage means 68, synthetic signal generator 214 which functions as a one-way flow means as well as functioning as a synthetic signal generator, and groove 106*a*.

Three-port shuttle valve 112 serves to select the highest fluid pressure from two fluid flow controlling devices or directional control valves. That is, if fluid flow controlling device 22 places a higher fluid pressure on control port 212 than another fluid flow controlling device or directional control valve (not shown) places on conduit 216, then three-port shuttle valve 112 intercommunicates control port 212 with signal conduit 218 and blocks communication between signal conduit 218 and conduit 216.

The other aforementioned components in control logic means 110, including three-port shuttle valve 114, form a logic means for selecting the load actuating pressure in first work port channel 44 or second work port channel 46. In addition, fluid flow through synthetic signal generator 214 is effective to increase the load actuating pressure of first work port channel 44, as developed by load 144 in motor port 164, by a predetermined pressure magnitude to change the load actuating pressure of fluid motor 34 into a synthetic signal pressure.

LOAD RESPONSIVE SYSTEM OPERATION DURING RAISING

Referring again to FIG. 2, when pump 26 is furnishing pressurized fluid to motor port 164 of fluid motor 34, the operation of control logic means 110 is as follows: signal fluid is furnished by pump 26 to signal conduit 218 by signal supply orifice 32. This signal fluid flows from signal conduit 218, to three-port shuttle valve 112, to control port 212, and then to three-port shuttle valve 114. With valve spool 54 moved to the right to the raising position as shown in FIG. 2, conduit 220 of three-port shuttle valve 114 is open to second return channel 50 via signal passage means 68.

At the same time, conduit 222 is pressurized by fluid flowing from service channel 42 via longitudinally extending groove 102*a*, or via shorter groove 103*a*, and signal passage means 62; so that ball 224 of three-port shuttle valve 114 is moved leftward blocking fluid flow from conduit 222 to conduit 220, and providing reversible flow communication between control port 212 and conduit 222.

The signal fluid being furnished by pump 26 and orifice 32 flows through synthetic signal generator 214 to first work port channel 44 via hole 215. At the same time, some fluid may flow from service channel 42 to conduit 222 and through synthetic signal generator 214 to first work port channel 44 via longitudinally extending groove 102*a* of FIG. 1, or via shorter groove 103*a* of FIG. 2; or some of the signal fluid furnished by orifice 32 may flow from conduit 222 to service channel 42 via signal passage means 62 and longitudinally extending groove 102*a* or shorter groove 103*a*, depending upon the operating conditions, and particularly depending upon the relative pressure magnitudes of service channel 42 and first work port channel 44. However, the limited conductance of grooves 102*a* and 103*a* prevents any malfunction thereby.

The fluid pressure in signal conduit 218, is, at this time, a synthetic signal pressure which is greater than the load actuating pressure of fluid motor 34 by a value which is determined by synthetic signal generator or relief valve 214. This synthetic signal pressure in conduit 218 is applied to effective output operator 227 which cooperates with spring 226 of by-pass valve 30 to maintain the pressure of pump 26 in conduit 162 to a value which is greater than the load actuating pressure in motor port 164 by the pressure differential across synthetic signal generator 214, and by the spring load of spring 226 divided by the projected area of operator 228 of by-pass valve 30. Any fluid flow from pump 26 which would tend to produce a higher pump pressure than that which has just been described will be bypassed from conduit 230 to conduit 232 and sump 28*a* via flow path 234.

LOAD RESPONSIVE SYSTEM OPERATION DURING LOWERING

Referring now to FIG. 3, the operation of the load responsive system during lowering is as follows: signal conduit 218 is communicated to second work port channel 46 via three-port shuttle valve 112, three-port shuttle valve 114, conduit 220, signal passage means 68, and longitudinally extending groove 106*a;* so that the pressure of pump 26 is controlled to be greater than the fluid pressure in second work port channel 46 by a pressure magnitude which is determined by the load of spring 226. Optionally, grooves 106*a* and 106*b* may be sized to have a conductance in relation to that of orifice 32 so that longitudinally extending grooves 106*a* and 106*b* act as a synthetic signal generator to raise the pressure of the signal fluid in signal conduit 218 to a predetermined pressure magnitude above the load actuating pressure in second work port channel 46.

LOAD RESPONSIVE SYSTEM OPERATION DURING STAND-BY

Referring now to FIG. 1, with valve spool 55 in the stand-by position as shown, both signal passage means 62 and signal passage means 68 are communicated to respective ones of return channels 48 and 50; so that control port 212 is in communication with either sump 28*b* or 28*c*, depending upon the chance positioning of ball 224. Thus, during stand-by, the pressure of pump 26 is controlled to be at a pressure level which exceeds sump pressure only by a value which is determined by spring 226 of by-pass valve 30; since the pressure in signal conduit 218 will be substantially equal to the fluid pressure in sump 28*b* or 28*c*.

SUMMARIZING COMMENTS ON THE FIRST EMBODIMENT

Referring finally to FIGS. 1 and 6, it has been shown that fluid flow controlling device 22 comprises a directional control valve 58 and a flow controlling means 60, flow controlling means 60 being interposed between a valve spool 55 and a first work port channel 44 of directional control valve 58.

Flow controlling means 60 includes a first fluid responsive operator 173 which comprises projected end 174 of plunger 56 and cooperating portions of body 36 that include chamber 152. In like manner, flow controlling means 60 includes a second fluid responsive operator 175 which comprises projected end 236 of plunger 56, and chamber 154. Further, chamber 154 comprises cooperating portions of spring cap 156 and body 36.

Fluid flow controlling device 22 includes flow signal means for applying fluid pressures to first and second fluid responsive operators 173 and 175. This flow signal means comprises signal passage means 64, groove 102*a*, signal passage means 66, groove 104*a*, check valve 192 and optionally check valve 199 for applying fluid pressures to first fluid responsive operator 173; and this flow signal means comprises signal passage means 62, longitudinally extending groove 102*a*, orifice 158, groove 130, hole 132*a*, and check valve 134 for applying fluid pressures to second fluid responsive operator 175. Alternately, the flow signal means may include groove 103*a* and groove 105*a*, or groove 103*a* and restrictor 101 in the place of groove 102*a*.

Referring now to FIGS. 1 and 6, valve spool 55 of fluid flow controlling device 22 or of directional control valve 58 thereof includes radial pressure balancing means. The radial pressure balancing means of valve spool 55 comprises flow passage means or longitudinally extending grooves 102*a* and 102*b* of FIG. 1 which provide radial pressure balance for portions of signal passage means 62 that are disposed on diametrically opposite sides of spool bore 38. That is, when valve spool 55 is moved to the first operating position as shown by valve spool 54 of FIG. 2, longitudinally extending grooves 102*a* and 102*b* of FIG. 1 both communicate with service channel 42 and a respective one of the portions 70*a* and 70*b* of FIG. 6 so that any radial pressure unbalance on valve spool 55 is effectively prevented. In like manner, grooves 102*a* and 102*b* of FIG. 1 prevent a radial pressure unbalance on similar portions of signal passage means 64 when valve spool 55 is moved to the second operating position as shown by valve spool 54 of FIG. 3.

Longitudinally extending grooves 104*a* and 104*b* of FIG. 1 are intercommunicated by radial pressure balancing hole 108 so that radial pressure unbalance is effectively avoided even though grooves 104*a* and 104*b* are not intercommunicated at this time by being exposed to one of the adjacent channels, 40 or 46.

Valve spool 55 of fluid flow controlling device 22 includes flow passage means for achieving radial pressure balancing which may comprise either a hole which extends orthogonally through valve spool 55, such as hole 108, a pair of longitudinally extending grooves 102*a* and 102*b* which communicate with a fluid channel such as service channel 42, or both a pair of longitudinally extending grooves and an interconnecting hole such as grooves 104*a* and 104*b* and hole 108.

DETAILED DESCRIPTION OF A SECOND PREFERRED EMBODIMENT

Figure 7:
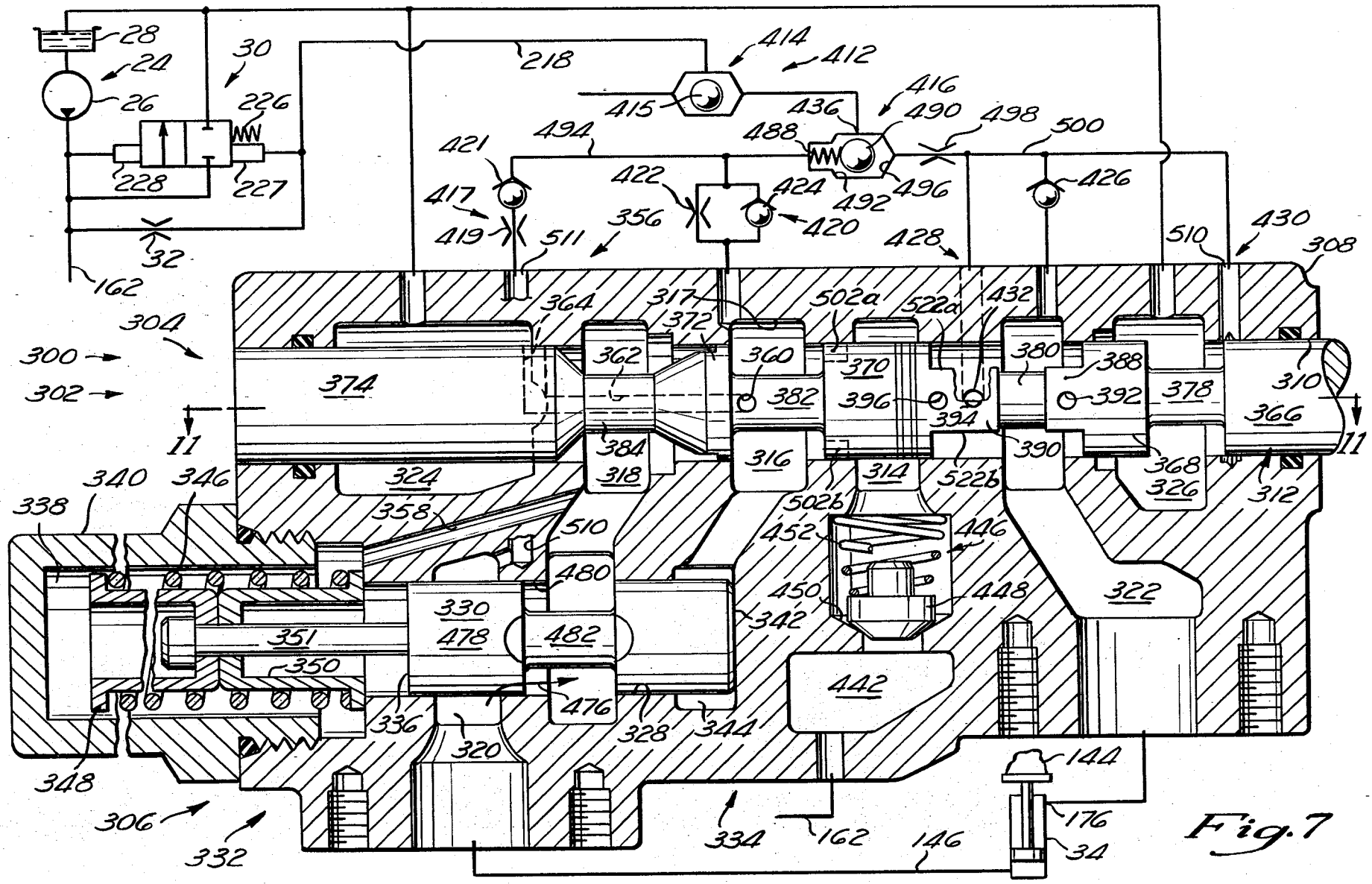
FIG. 7 is a cross-sectional drawing of a second preferred embodiment of the invention with the valve spool of the directional control valve thereof in the stand-by position, and with the other components of the system depicted schematically.

Referring now to FIGS. 7–11 and 11A, a second preferred embodiment of the present invention is illustrated. In FIGS. 8–10 and 11A, this second embodiment is shown as a regenerative valve; whereas, in FIGS. 7 and 11, the regenerative feature has been omitted. Also, a portion of the schematic portion of the system has been eliminated in FIGS. 8–10; but it should be understood that the circuitry of FIG. 7 is usable with the fluid flow controlling device of FIGS. 8–10.

Referring now particularly to FIG. 7, load responsive system 300 includes fluid flow controlling device 302, source of pressurized fluid 24 which comprises pump 26 and sump 28, by-pass valve 30, signal supply orifice 32, and fluid motor 34.

Fluid flow controlling device 302 generally comprises directional control valve 304 and flow controlling means 306. Directional control valve 304 includes body 308 having spool bore 310 therein; and valve spool or movable valving element 312 is slidably fitted into spool bore 310.

Directional control valve 304 also includes pressure inlet channel 314, auxiliary pressure channel or signal channel 316 which serves as an intercepting means, service channel 318, first work port channel 320, second work port channel 322, and a return port means which comprises first return channel or branch channel 324 and second return channel 326, all of which intercept spool bore 310 with the exception of first work port channel 320.

Flow controlling means 306 is interposed between valve spool 312 and first work port channel 320 and includes plunger bore 328 which intercepts and interconnects service channel 318 and first work port channel 320; and also includes flow control plunger 330 which is slidably inserted into plunger bore 328.

Flow controlling means 306 further comprises first fluid responsive operator 332 and second fluid responsive operator 334. First fluid responsive operator 332 comprises the projected area of end 336 of plunger 330, cooperating portions of body 308 including a part of plunger bore 328, and spring cavity 338 of spring cap 340. Second fluid responsive operator 334 comprises the projected end area of end 342 of flow control plunger 330, and cooperating portions of body 308 which include chamber 344 of auxiliary pressure channel 316.

Flow controlling means 306 further comprises centering spring or resilient bias means 346, spring adapter 348, spring adapter 350, bolt 351, and spring cap 340.

Figure 8:
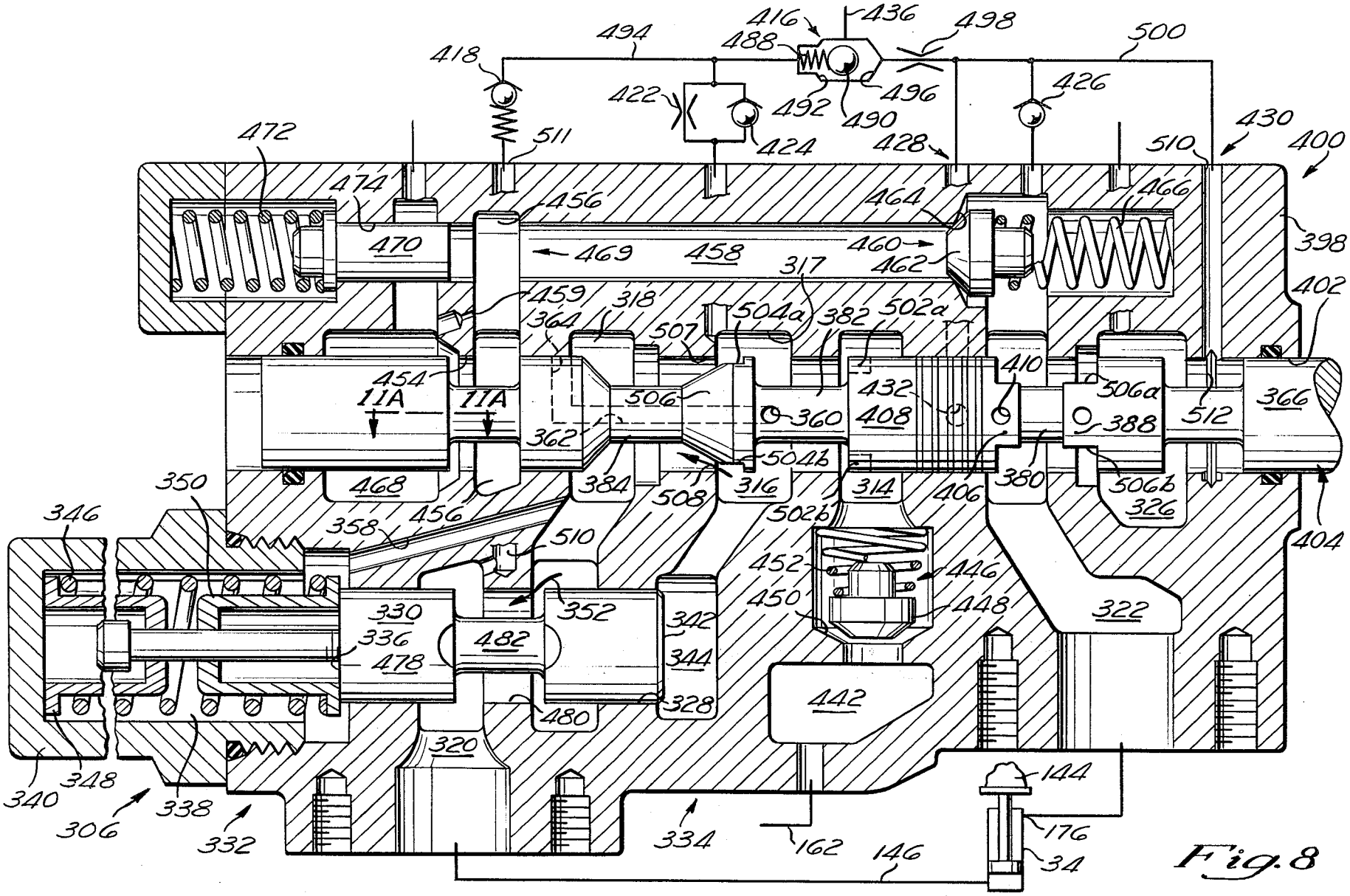
FIG. 8 is a cross-sectional and schematic drawing as FIG. 7, but with low pressure regeneration included in the fluid flow controlling device, with the pump and some other system components omitted, and with the valve spool moved to the load raising position.
Figure 9:
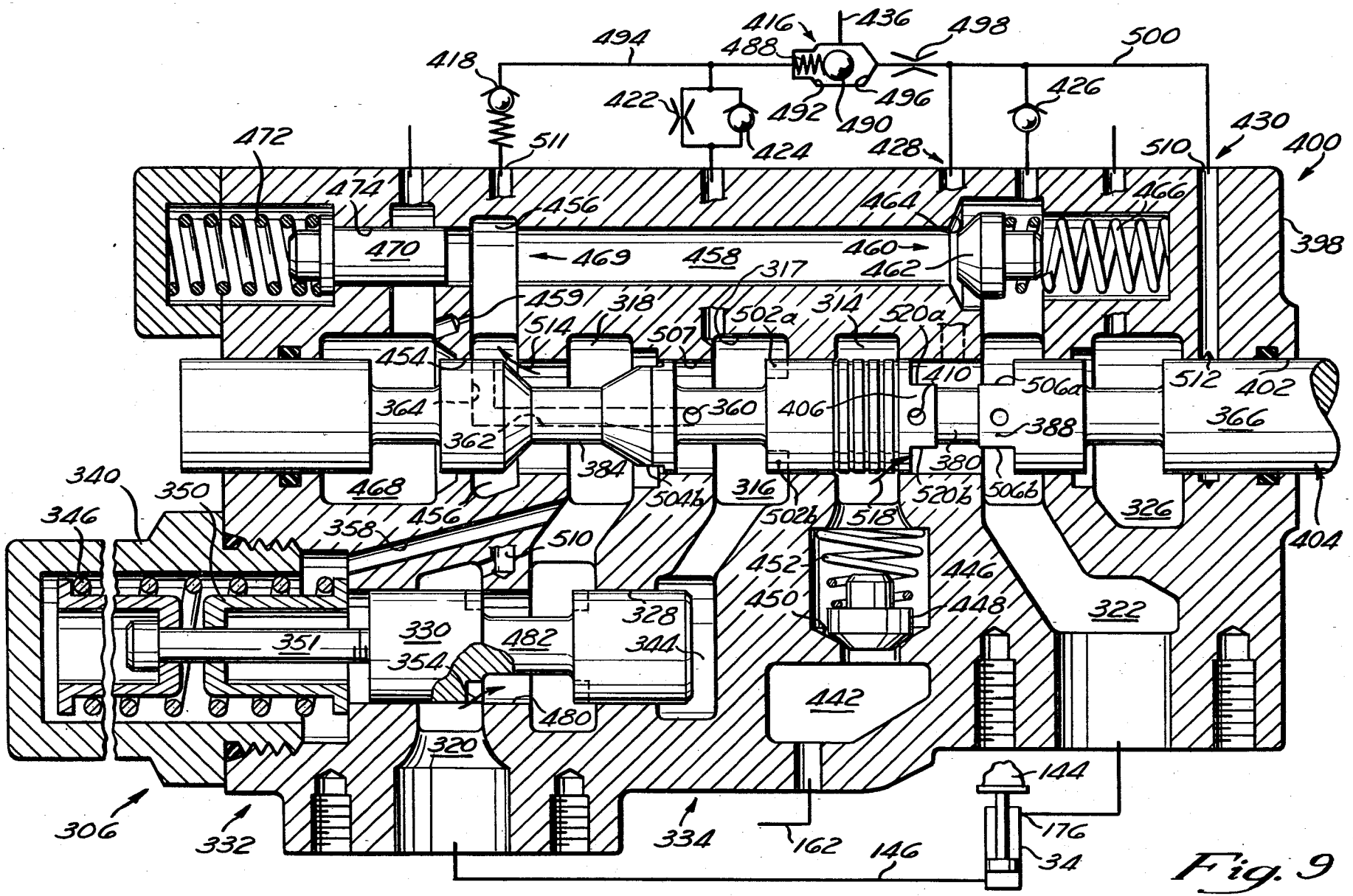
FIG. 9 is a cross-sectional and schematic drawing as FIG. 8, but with the valve spool moved to the regenerative lowering position.
Figure 10:
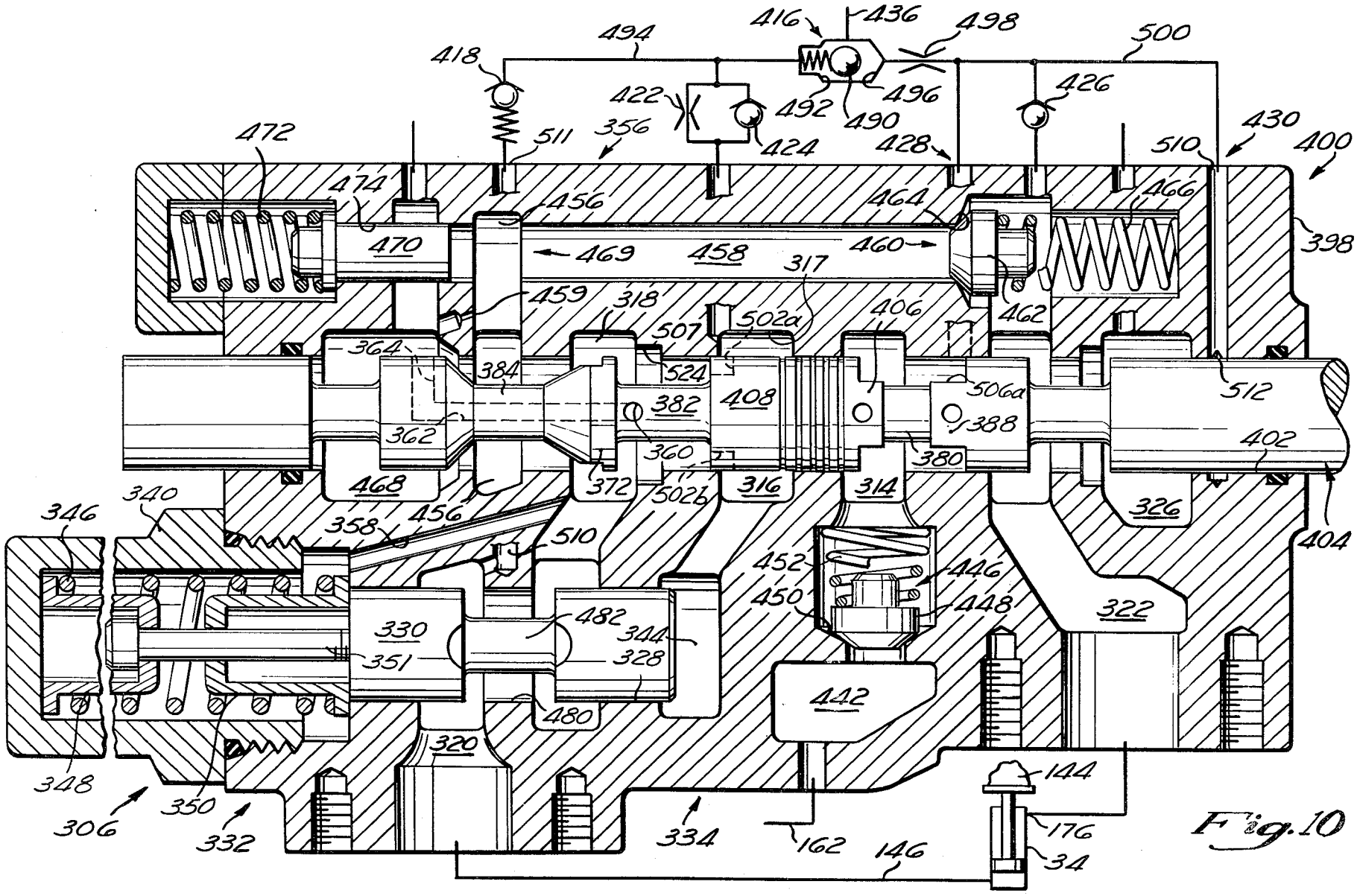
FIG. 10 is a cross-sectional and schematic drawing as FIG. 8, but with the valve spool moved to the float position.

Referring now to FIGS. 7–10, in FIG. 10, flow control plunger 330 is shown in a spring centered or free-flow position, in FIG. 7, flow control plunger 330 is shown in a flow blocking position that provides the load holding function, in FIG. 8, flow control plunger 330 is shown in a first flow throttling position in which throttling flow path 352 controls fluid flow from pressure inlet channel 314 to first work port channel 320, and in FIG. 9, flow control plunger 330 is shown in a second flow throttling position in which throttling flow path 354 controls the return of fluid from motor 34 via first work port channel 320.

Referring again to FIG. 7, flow controlling means 306 includes flow signal means 356 which selectively supplies fluid pressures to first fluid responsive operator 332 and second fluid responsive operator 334. Flow signal means 356 includes longitudinal hole or passage 358 for applying fluid pressures to first fluid responsive operator 332; and flow signal means 356 includes a radial hole 360, longitudinal hole or longitudinal passage 362, and radial hole 364 which cooperate with auxiliary pressure channel 316 and first return channel 324 in supplying fluid pressures to second fluid responsive operator 334.

Figure 11A:
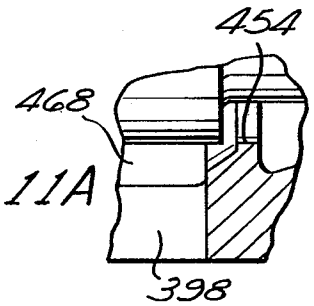
FIG. 11A is a partial cross-section, taken substantially as shown by section line 11A—11A in FIG. 8 and showing the extra bore land in the device of FIGS. 8–10.
Figure 11:
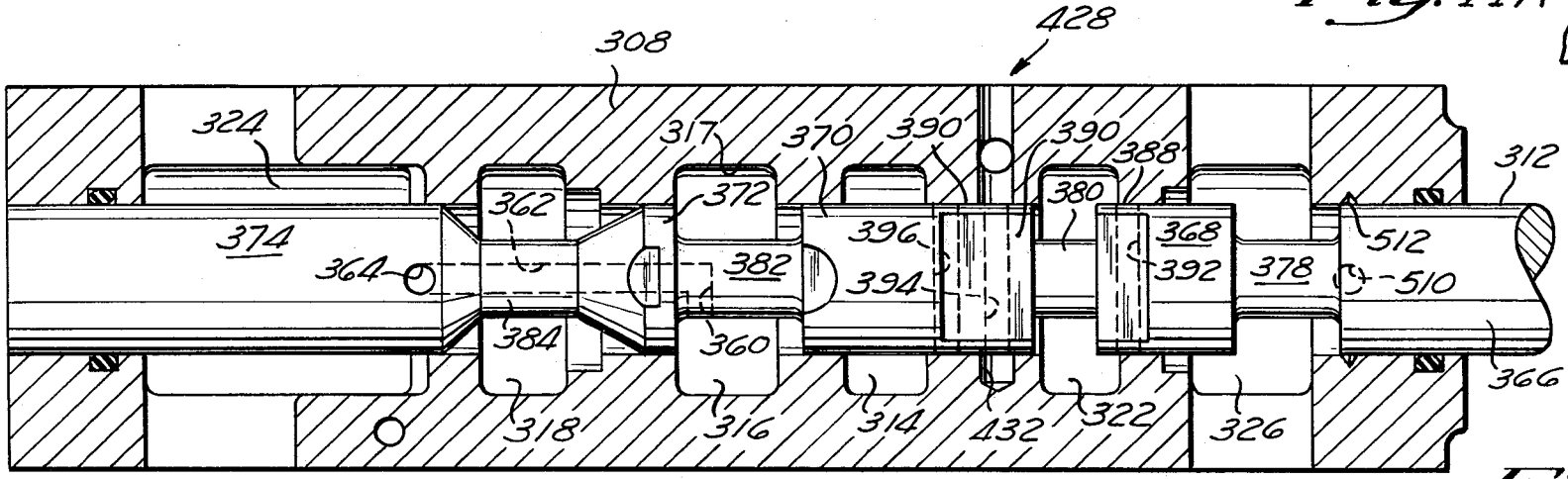
FIG. 11 is a cross-sectional view of the directional control valve of FIG. 7, taken substantially as shown by section line 11—11 in FIG. 7 but with a portion broken out to show the construction of FIGS. 8–10.

Referring now to FIGS. 7 and 11, valve spool 312 includes cylindrical land portions 366, 368, 370, 372, and 374 which are spaced apart by respective ones of reduced cross-section portions 378, 380, 382, and 384.

Valve spool 312 also includes tang means 388 and tang means 390 which are similar to tang means 88 of FIG. 1, and which have similar cylindrical surfaces and side faces; so that a detailed description of tang means 388 and tang means 390 is not necessary. However, it should be noted that tang means 388 includes radial pressure balancing hole 392 and tang means 390 includes radial pressure balancing holes 394 and 396.

In comparison, referring to FIG. 8, valve body 398 of fluid flow controlling device 400 includes spool bore 402 into which is fitted valve spool 404; and tang means 406 of land 408 of valve spool 404 includes radial pressure balancing hole 410.

Referring now to FIG. 7, fluid flow controlling device 302 further includes control logic means 412. Control logic means 412 comprises three-port shuttle valve 414, three-port shuttle valve 416, synthetic signal generator and one-way flow means 417 that includes both orifice 419 and check valve 421, check and orifice device 420 that includes orifice 422 and check valve 424, check valve 426, signal passage means 428, and attenuation passage means 430.

Referring now to FIGS. 7 and 8, synthetic signal generator or relief valve 418 replaces both orifice 419 and check valve 421 of FIG. 7, replacing the restriction to fluid flow of orifice or synthetic signal generator 419 with relief valve 418, and incorporating the one-way flow function of check valve 421 into relief valve 418.

Referring now to FIGS. 7, 8, and 11, signal passage means 428 comprises local signal passage 432 of all three figures, and tang means 388 and tang means 390 of FIGS. 7 and 11, or tang means 388 and tang means 406 of FIG. 8.

Referring again to FIG. 7, control logic means 412 functions as a primary logic means to communicate control port 436 of three-port shuttle valve 416 with first work port channel 320 when pressure inlet channel 314 is communicated with first work port channel 320, to communicate control port 436 with second work port channel 322 when pressure inlet channel 314 is communicated to second work port channel 322, and to communicate control port 436 with one of the return channels 324 or 326 when pressure inlet channel 314 is isolated from both first work port channel 320 and second work port channel 322.

Three-port shuttle valve 414 of control logic means 412 functions as a secondary logic means to communicate signal conduit 218 with control port 436 when the fluid pressure in control port 436 exceeds the fluid pressure in conduit 440; and three-port shuttle valve 416 is effective to communicate signal conduit 218 with conduit 440 when the fluid pressure in conduit 440 exceeds that which is in control port 436.

Referring to FIGS. 7 and 8, valve bodies 308 and 398 both include pressure passage 442 which is connected to pump 26 of FIG. 7 by conduit 162, and load checks 446 which includes poppet 448, seat 450, and spring 452.

Referring finally to FIGS. 8 and 11A, valve body 398 includes bore land 454, transfer or regeneration channel 456, transfer or regeneration loop 458, and first return channel 468. Transfer or regeneration channel 456 and first return channel 468 serve as branch channels of a return port means that also includes return port 326. Regeneration check valve 460 of fluid flow controlling device 400 includes poppet 462, seat 464, and spring 466 and provides one-way fluid communication from regeneration loop 458 to second work port channel 322; and regeneration relief valve 469 includes piston 470 and spring 472, piston 470 being slidably fitted into bore 474.

OPERATION IN STAND-BY POSITION

Referring again to FIG. 7, when valve spool 312 is in the stand-by position as shown, pressurization of conduit 146 and first work port channel 320 by load 144 of motor 34 causes a small rate of fluid leakage from first work port channel 320 to service channel 318 via leakage flow path 476 which exists between cylindrical land portion 478 of flow control plunger 330 and bore land 480 of plunger bore 328. This leakage of pressurized fluid from first work port channel 320 to service channel 318 is effective to pressurize first fluid responsive operator 332 via hole 358 so that flow control plunger 330 is held in the position shown in FIG. 7.

Only a very low fluid pressure in service channel 318 is effective to move and to hold plunger 330 in the flow blocking or stand-by position because chamber 344 of second fluid responsive operator 334 is communicated to return channel 324 via holes 360, 362, and 364, at this time.

If flow control plunger 330 should be initially, upon the moving of valve spool 312 to the stand-by position, in a position wherein the first work port channel 320 is communicated to service channel 318 via reduced cross-section portion 482 of plunger 330, then plunger 330 will immediately be moved to the load holding position, as shown, by flow of fluid from first work port channel 320 to first fluid responsive operator 332 via service channel 318 and hole 358.

During the stand-by operation as depicted in FIG. 7, pressure inlet channel 314 is isolated from both second work port channel 322 and service channel 318; and both service channel 318 and second work port channel 322 are isolated from both return channels, 324 and 326.

Also, in the stand-by position of FIG. 7, control logic means 412 provides an attentuation flow path from control port 436 to first return channel 324. This attentuation flow path to first return channel 324 is achieved by spring 488 of three-port shuttle valve 416 which resiliently urges ball 490 from seat 492 to establish a fluid flow path from control port 436 to first return channel 324 via check valve 424 which communicates with auxiliary pressure channel 316, and via flow signal means 356 which comprises hole 360, hole 362, and hole 364.

Because of the incorporation of spring 488 into three-port shuttle valve 416, the aforementioned attenuation flow path from control port 436 to first return channel 324 always exists during stand-by operation; whereas, without spring 488, ball 490 would be chance or gravity located between seat 492 and seat 496. With chance or gravity location of ball 490, synthetic signal generator or orifice 498 could not be interposed into conduit 500 since the restriction of orifice 498 would interfere with attenuation fluid flow from control port 436 to attenuation passage means 430 when ball 490 happened to seal against seat 492.

Referring now to FIG. 8, in fluid flow controlling device 400, holes 360, 362, and 364 deliver the signal fluid to regeneration channel 456, rather than to return channel 468 as it does in fluid flow controlling device 302 of FIG. 7. Therefore, to complete an attentuation flow path to a sump, attentuation orifice 459 has been added to body 398.

A complete discussion of spring biased three-port shuttle valves is included in U.S. Pat. No. 4,089,169 of common assignee, so that a brief description herein will suffice.

OPERATION DURING RAISING

Referring now to FIG. 8, with valve spool 404 moved to the first operating position as shown, pressure inlet channel 314 is communicated to auxiliary pressure channel or signal channel 316 via notches 502*a* and 502*b* and reduced cross-section portion 382; and auxiliary pressure channel 316 is communicated to service channel 318 via metering notches 504*a* and 504*b*, conical section 506, and reduced cross-section portion 384. At the same time, second work port channel 322 is communicated to second return channel 326 via reduced cross-section portion 380 and notches 506*a* and 506*b* of tang means 388. Thus pressurized fluid is delivered from pump 26 (FIG. 7) and conduit 162 to fluid motor 34 via load check 446, pressure inlet channel 314, auxiliary pressure channel 316, service channel 318, first work port channel 320, and conduit 146. At the same time, fluid is discharged from fluid motor 34 to second return channel 326 via second work port channel 322.

Movement of valve spool 404 to the first operating or raising position as shown in FIG. 8 is effective, in cooperation with bore land 507, to establish and to selectively size a throttling orifice or first fluid flow path 508 between auxiliary pressure channel 316 and service channel 318. The effective cross-sectional area of throttling orifice or first fluid flow path 508 is effective to develop a pressure differential between auxiliary pressure channel 316 and service channel 318 which is dependent upon the rate of fluid flow between these two channels. The upstream pressure of auxiliary pressure channel 316 is applied to second fluid responsive operator 334, and the downstream pressure of service channel 318 is applied to first fluid responsive operator 332 via hole 358; so that flow control plunger 330 is moved leftwardly to the throttling position shown in FIG. 8 wherein throttling flow path 352 is effective to limit the rate of fluid flow from pressure inlet channel 314 to fluid motor 34 as a function both of the load of spring 346 and the cross-sectional area of first fluid flow path 508.

LOAD RESPONSIVE SYSTEM OPERATION DURING RAISING

During the raising function of FIG. 8, control port 436 is communicated to first work port channel 320 via three-port shuttle valve 416, synthetic signal generator 418, and hole 511. At this time, ball 490 of three-port shuttle valve 416 is actuated into sealing engagement with seat 496 by pump fluid which is delivered from auxiliary pressure channel 316 to conduit 494 via orifice 422. This movement of ball 490 into sealing engagement with seat 496 is unopposed by any fluid pressure in conduit 500 because attentuation passage means 430 communicates conduit 500 to second return channel 326, cylindrical land portion 366 being moved rightwardly to fully expose attentuation signal passage 510 and internal groove 512 of attentuation passage means 430 to second return channel 326.

The fluid pressure in control port 436 is then effective to establish reversible fluid communication between control port 436 and conduit 218 (FIG. 7), and to block fluid communication from either control port 436 or conduit 218 to conduit 440, by the actuation of ball 415 (FIG. 7); so that the pressure and effective output of pump 26 is controlled by the fluid pressure in control port 436.

SYNTHETIC SIGNAL PRESSURE DURING RAISING

Referring once more to FIG. 8, the fluid supplied from pump 26 (FIG. 7) to conduit 494, via auxiliary pressure channel 316 and orifice 422, flows to first work port channel 320 via synthetic signal generator 418. At the same time, signal fluid which is furnished to conduit 494 by signal supply orifice 32 also flows through synthetic signal generator 418 to first work port channel 320. Thus the synthetic signal pressure in conduit 494, and in operator 27 of by-pass valve 30, is equal to the load actuating pressure in first work port channel 320 plus the pressure differential across synthetic signal generator 418 as developed by the combined fluid flow from orifice 32 and orifice 422.

The use of a relief valve, such as synthetic signal generator 418, is preferred for use as a synthetic signal generator, rather than orifice 419 of FIG. 7, where two flows of signal fluid are supplied; since a relief valve may be designed to have a flatter curve of pressure vs. flow than that of an orifice; and so the resultant synthetic signal is more reliably a constant pressure differental above the load actuating pressure when a relief valve is used for a synthetic signal generator.

REGENERATIVE LOWERING

Referring now to FIG. 9, with valve spool 404 moved leftwardly to the second operating position as shown, service channel 318 is communicated with regeneration channel 456; so that load 144 of motor 34 is effective to deliver fluid from motor 34 to regeneration channel 456 via reduced cross-section portion 482 of plunger 330, service channel 318, and reduced cross-section portion 384 of valve spool 404. This movement of valve spool 404 to the second operating position shown in FIG. 9 is effective to establish a second fluid flow path or throttling orifice 514 between service channel 318 and regeneration channel 456; and the effective cross-sectional area of second fluid flow path 514; together with the rate of fluid flow from service channel 318 to regeneration channel 456, is effective to develop a pressure differential between these two channels. The upstream pressure in channel 318 is applied to first fluid responsive operator 332 via hole 358; and the downstream pressure in regeneration channel 456 is applied to second fluid responsive operator 334 via the flow signal means which comprises hole 360, 362, and 364.

During the regenerative lowering of FIG. 9, the fluid being exhausted from fluid motor 34 via first work port channel 320 and regeneration channel 456 is transferred to second work port channel 322 and motor port 176 of fluid motor 34 via regeneration loop 458 and regeneration check valve 460, any excess fluid in regeneration channel 456 being exhausted to return channel 468 by regeneration relief valve 469.

REGENERATIVE AND POWER LOWERING

Referring again to FIG. 9, a slight additional leftward movement of valve spool 404 beyond that which is shown in FIG. 9, will establish fluid flow path 518 which will supply pressurized fluid from pressure inlet channel 314 to second work port channel 322 via notches 520*a* and 520*b* of tang means 406.

Fluid flow path 518 allows down pressure to be put on fluid motor 34, applying pressurized fluid to motor port 176. During this operation, the down pressure which is applied to motor port 176 is applied to conduit 500 via signal passage means 428; so that ball 490 of three-port shuttle valve 416 is actuated leftwardly into sealing contact with seat 492 thereby establishing reversible fluid flow communication between control port 436 and second work port channel 322. Then the fluid being supplied by signal supply orifice 32 (FIG. 7) is delivered to second work port channel 322 via synthetic signal generator or orifice 498; and by-pass valve 30 (FIG. 7) is controlled by a synthetic signal pressure in operator 227 which is the sum of the load actuating pressure in second work port channel 322 and the pressure differential which is caused by the signal fluid flowing through orifice 498.

LOWERING WITHOUT REGENERATION

Referring now to FIGS. 7 and 9, land 454 and transfer or regenerative loop 458 of FIG. 9 have been removed in the FIG. 7 modification. Also notches 522*a* and 522*b* of valve spool 312 of FIG. 7 are longer than notches 520*a* and 520*b* of valve spool 404 of FIG. 9; so that the movement of valve spool 312 of FIG. 7 leftwardly to a lowering position comparable to that of valve spool 404 of FIG. 9 is effective to communicate pressure inlet channel 314 with second work port channel 322. Thus the lowering of load 144 always depends upon the supply of pump pressurized fluid from pressure inlet channel 314.

Also, with land 354 of FIG. 9 removed, as shown in FIGS. 7 and 11, second fluid flow path 514, of FIG. 9, will communicate with return channel 324 of FIGS. 7 and 11.

INACTIVATION OF FLOW CONTROLLING MEANS 422

Referring now to FIG. 10, with valve spool 404 moved leftwardly to the float position as shown, cylindrical land portion 372 of valve spool 404, which is shorter in length than the length of service channel 318, is positioned so that fluid surrounding reduced cross-section portion 382 of valve spool 404 is in free-flow communication with the fluid pressure in service channel 318. Also notches 502*a* and 502*b* are communicating auxiliary pressure channel 316 with the fluid space which surrounds reduced cross-section portion 382. Therefore the fluid pressure that is applied to first fluid responsive operator 332 via passage 358 and the fluid pressure that is applied to second fluid responsive operator 334 via notches 502*a* and 502*b* are identical; so that any actuation of flow control plunger 330 by fluid pressure developed by flow between service channel 318 and transfer channel 456 is precluded.

If valve spool 404 of FIG. 10 is moved rightwardly from the position shown, this intercommunication of fluid responsive operators 322 and 334 will be extended for a greater movement of valve spool 404 rightwardly by circumferential groove 524; and so groove 524 effectively increases the length of service channel 318. Thus, fluid flow controlling device 302 includes means for inactivating flow controlling means 306 which comprises circumferential groove 524.

FLOAT OPERATION

Referring again to FIG. 10, with valve spool 404 moved to the float position shown, service channel 318 is communicated to first return channel 468 via regeneration channel 456; and second work port channel 322 is communicated to second return channel 326. Thus fluid motor 34 is free to move in either direction thereof.

During the float operation of FIG. 10, control port 436 is communicated with first return channel 468 via check valve 424, auxiliary pressure channel 316, and flow signal means 356 which comprises holes 360, 362, and 364. Therefore, in the float position, flow controlling means 306 places no restriction upon signal fluid being delivered to control port 436 by orifice 32 (FIG. 7).

SUMMARIZING COMMENTS ON BOTH EMBODIMENTS

Two embodiments of the present invention have been described. In both embodiments, the fluid flow controlling device comprises a directional control valve with flow controlling means interposed between the valve spool and the first work port channel of the directional control valve.

The flow controlling means of both embodiments includes a flow control plunger that is movable from a free-flow position to both flow throttling and flow blocking positions. A flow blocking position is a position wherein the flow of fluid is entirely prevented or blocked and a flow throttling position is a position wherein the rate of fluid flow is restricted, reduced, or controlled.

The free-flow position of the flow control plunger is that position in which there is minimum resistance to fluid flow from the first work port channel to the valving element means.

The flow control plunger is actuated to a flow throttling position for control of the rate of fluid flow through the first fluid flow path by the application of upstream and downstream pressures to respective ones of the fluid responsive operators. The first flow path upstream pressure is obtained from the pressure inlet channel and the first flow path downstream pressure is obtained from the service channel means. For control of the rate of fluid flow through the second fluid flow path, the second flow path upstream pressure is obtained from the service channel means and the second flow path downstream pressure is obtained from the return port means.

The flow controlling means of both embodiments includes resilient bias means for urging the flow control plunger toward one of the positions thereof.

The resilient bias means of the first embodiment preferably includes spring 124 which provides a load that, divided by the projected end area of the plunger, is equivalent to 125 psi, and spring 120 that is equivalent to 25 psi. Thus the maximum flow capacity of the flow controlling device is a function of the larger pressure and yet the pressure that is required to open the check valve is the lower pressure. If only the heavier spring were used and spring 124 forced plunger 56 to the flow blocking position of FIG. 3, and the projected end area of shuttle piston 128 were equal to the projected end area of plunger 56, then a fluid pressure of 125 psi in second work port channel 46 would be required to actuate plunger 56 from the load check position to the free-flow position.

The resilient bias means of the second embodiment preferably, for simplicity, includes a single centering spring that actuates the flow control plunger to the free-flow position from both flow throttling positions with the same force so that the maximum flow capacity of the flow controlling device for raising and lowering flow is the same; although, in many applications, it is desirable to lower a load at least twice as fast as it is raised.

The flow controlling means of both embodiments includes first and second fluid responsive operators for actuating the flow control plungers; and both fluid flow controlling means include flow signal means for applying fluid pressures to the fluid responsive operators.

The flow signal means of both embodiments includes signal passage means, 62, 428, etc., which comprises an interception of the spool bore of the directional control valve portion of the flow controlling means. The second embodiment includes auxiliary pressure channel or signal channel 316 which functions not only as a signal passage but which also, by virtue of circumferential groove 317 thereof, functions as a by-pass port to interconnect two adjacent fluid channels when a cylindrical land portion of the valve spool is centered in circumferential groove 317, as shown in FIG. 8. Thus a signal passage is not a signal channel; but a signal channel is a signal passage.

Both embodiments utilize tang means on one cylindrical land portion of their respective valve spools for selectively blocking the signal passages; and both embodiments include flow passage means in the valve spools for radially balancing the cylindrical land portion or the tang means thereof when a signal passage is blocked.

In the first embodiment, the flow passage means comprises longitudinally extending grooves 102*a* and 102*b* of FIG. 1, or holes 107*a*, 107*b*, and 107*c* of FIG. 2; and in the second embodiment, the flow passage means comprises radial pressure balancing holes 394 and 396 of FIG. 7 or hole 410 of FIG. 9.

The directional control valve portion of both embodiments is preferably fitted with a centering spring device, not shown, which is common in the art for use with this type of device, which may include a detent mechanism for the float position, and which is not a part of the present invention.

Both embodiments include one variation without regenerative lowering and one variation with regenerative lowering.

In the first embodiment, with connection points 200 and 202 interconnected, the regeneration feature is omitted, and the return port means includes return channels 48 and 50; whereas with connection points 200 and 204 interconnected, the regeneration feature is included, and the return port means includes channel 48 which has become as a transfer channel, and return channel 50.

In the second embodiment, the transfer channel and transfer loop for regeneration has been omitted in the fluid flow controlling device 22 of FIG. 7, and the return port means comprises return channels 324 and 326; whereas in fluid flow controlling device 400 of FIGS. 8–10, the regenerative feature is included, and the return port means includes return channel 326, transfer channel 456, and return channel 468.

If valve spool 55 of the first embodiment of FIG. 1 were modified to incorporate a float position, and if valve spool 55 were moved leftwardly as far as valve spool 404 is moved in FIG. 10, then longitudinally extending groove 102*a* would intercommunicate inlet channel 40 with service channel 42, and pump fluid would be lost from inlet channel 40 to return channel 48 via longitudinally extending groove 102*a* of FIG. 1 and fluid flow path 182 of FIG. 3. However, by replacing groove 102*a* of FIG. 1 by shorter groove 103*a* and plunger groove 105*a* of FIG. 2, or by shorter groove 103*a* and restrictor 101 of FIG. 3, this fluid loss would not occur. Thus the use of shorter groove 103*a* and restrictor 101, or shorter groove 103*a* and plunger groove 105*a*, and radial balancing holes 107*a*, 107*b*, and 107*c*, allow longer strokes of the valve spool 54 of FIGS. 1 and 2, than of the valve spool 55 of FIG. 1, in a given length of valve body without fluid loss by undesirable intercommunication of fluid channels by longitudinally extending grooves such as grooves 102*a* and 102*b* of FIG. 1 and 103*a* of FIGS. 2 and 3.

While both embodiments of the present invention are usable in conventional open-center and closed-center systems, they are preferably used in load responsive systems, and they are more preferably used in load responsive systems of the synthetic signal type which are fully described in U.S. Pat. No. 3,971,216 of common assignee.

Referring again to FIG. 7, if the restricted fluid communication between conduit 162 and conduit 218 via orifice 32 is eliminated, then during the raising function of FIG. 8, the only source of signal fluid is that which is furnished via auxiliary pressure channel 316 and orifice 422. Then the synthetic signal pressure in conduit 494 is a function of the supply restrictor or orifice 422 and the synthetic signal generator or relief valve 418, which are connected in series; and the synthetic signal pressure, which controls by-pass valve 30, is the pressure intermediate of these two series-connected elements.

That is, relief valve 418 and orifice 422 of FIG. 8 function as series-connected restrictors and orifice 419 and orifice 422 of FIG. 7 function as series-connected restrictors; and either relief valve 418, or the combination of orifice 419 and check valve 421, serves as a one-way flow and restrictor means.

Also, notches 502*a* and 502*b* cooperate with orifice 422 to provide valved restrictor means; so that notches 502*a* and 502*b* of valve spool 404 cooperate with reduced cross-section portion 382 of valve spool 404, with pressure inlet channel 314, and with orifice 422 to provide a valved signal supply function which is called a valved signal means and which is described in detail in a U.S. patent application of common inventorship entity, common assignee, and common filing date, and which detailed description thereof is incorporated herein by reference thereto.

One advantage of the valved signal supply function is that the signal supply orifice can be eliminated, thus eliminating the constant flow of signal fluid, and thereby eliminating the need for check valve 426 which provides a flow path for the signal fluid to flow to return channel 326 when valve spool 404 is in the float position as shown in FIG. 10.

Another advantage of the valved signal supply principle is its use in sensing of the load actuating pressure in a work port that is downstream of the directional control valve with respect to a flow control device; because this sensing of load actuating pressure can not (without undue complexity of design) be controlled by the valve spool of the directional control valve.

The sensing of the load actuating pressure is achieved by selectively valving a flow of signal fluid from the pressure inlet channel into a work port channel and by preventing reverse fluid flow from the work port channel by means of a one-way flow valve.

If the synthetic signal function is desired, and if a check valve is used as the one-way flow valve, an orifice may be placed in series with the one-way flow valve as shown in FIG. 7; or a relief valve may be used to provide both the one-way flow function and the flow restricting function of a synthetic signal generator, as shown in FIG. 8.

Another advantage of the valved signal principle is the use of pump supplied fluid pressure to actuate the ball or shuttle in a three-port shuttle valve such as three-port shuttle valve 416 of FIG. 8 wherein pump pressurized fluid of auxiliary pressure channel 316 is supplied to conduit 494 via orifice 422 to actuate ball 490 rightwardly and thereby to establish fluid communication from control port 436 to conduit 494 if spring 488 is not used to urge ball 490 away from seat 492.

In similar manner, groove 102*a* of FIG. 1, or groove 103*a* of FIGS. 2 and 3, is effective to supply fluid pressure from service channel 42 to conduit 222 and three-port shuttle valve 114 via signal passage means 62 in order to actuate ball 224 of three-port shuttle valve 114.

In like manner, the pump pressurized fluid of auxiliary pressure channel 316 of FIG. 8, and the service channel fluid of service channel 42 of FIGS. 1–3, are effective to respectively actuate three-port shuttle valve 414 of FIG. 7 and three-port shuttle valve 112 of FIGS. 1–3.

Finally, the use of a single service channel to interconnect the directional control valve portion of the fluid flow controlling device with the flow controlling means thereof provides a compact, relatively inexpensive, low leakage, and highly stable device that may include load check, load lock, load holding, anticavitation lowering control, selective inactivation of the flow control feature, float, and regeneration functions as well as flow control functions for both raising and lowering.

While there have been described above the principles of this invention in connection with specific apparatus, it is to be clearly understood that this description is made only by way of example and not as a limitation to the scope of the claims.

While numbers of particular parts have been inserted parenthetically into the claims, it is to be clearly understood that these parenthetically enclosed part numbers are made by way of example only and not as a limitation to the scope of the claims.

What is claimed is:

1. In a fluid flow controlling device (22 of FIG. 1, 203 of FIG. 7, or 400 of FIG. 8) of the type having a body (36, 308, or 398) that includes a pressure inlet channel (40 or 314), that includes a first work port channel (44 or 320), and that includes return port means (48+50, 324+326, or 326+456+468) with a first branch channel (48, 324, or 456), and having selective communication means in said body for selectively communicating said pressure inlet channel with said first work port channel, and for selectively communicating said first work port channel with said first branch channel, the improvement in which said selective communication means comprises:

serivce channel means (42 or 318), in said body being interposed intermediate of said pressure inlet channel and said first branch channel, for receiving fluid from said pressure inlet channel and for returning fluid to said first branch channel;

selectively positionable valving element means (54, 312, or 404), communicating with said pressure inlet channel, with said work port channel, and with said service channel means, and being movable from a stand-by position (FIG. 1 or FIG. 7) wherein said first work port channel is isolated from said pressure inlet channel, to a first operating position (FIG. 2, or FIG. 8) for establishing and selectively sizing a first fluid flow path (170 of FIG. 2, or 508 of FIG. 8) from said pressure inlet channel to said service channel means, and to a second operating position (FIG. 3, or FIG. 9) for establishing and selectively sizing a second fluid flow path (182 of FIG. 3, or 514 of FIG. 9) from said service channel means to said first branch channel; and flow controlling means (60 or 306), interconnecting said service channel means and said first work port channel, and comprising a flow control plunger (56) that is movable from a free-flow position (FIG. 4), for controlling the rate of fluid flow through said first fluid flow path in proportion to said selective sizing thereof, and for controlling the rate of fluid flow through said second fluid flow path in proportion to said selective sizing thereof.

2. A fluid flow controlling device as claimed in claim 1 in which said device includes control logic means (110 of FIG. 1, or 412 of FIG. 7), comprising a control port (212 or 436), and comprising cooperating portions (88 & 94, or 364 & 366) of said valving element means, for communicating said control port with said first work port channel when said valving element means is in said first operating position, and for communicating said first work port channel to a source (24 of FIG. 1) of pressurized fluid to control the effective output of said source by connection of said control port thereto.

3. A fluid flow controlling device as claimed in claim 2 in which said control logic means further comprises one-way flow means (214, 421, or 426) for preventing fluid flow from said work port channel to said control port.

4. In a fluid flow controlling device (22 of FIG. 1, 302 of FIG. 7, or 400 of FIG. 8) of the type having a body (36, 308, or 398) that includes a pressure inlet channel (40 or 314), that includes a first work port channel (44 or 320), and that includes return port means (48+50, 324+326, or 326+456+468) with a first branch channel (48, 324, or 456), and having a selective communication means in said body for selectively communicating said pressure inlet channel with said first work port channel, and for selectively communicating said first work port channel with said first branch channel, the improvement in which said selective communication means comprises:

service channel means (42 or 318), in said body being interposed both intermediate of and adjacent to said pressure inlet channel and said first branch channel, for receiving fluid from said pressure inlet channel and for returning fluid to said first branch channel;

valving element means in said body (54, 312, or 404), being movable from a stand-by position (FIg. 1, or FIG. 7) wherein said first work port channel is isolated from said pressure inlet channel, to a first operating position (FIG. 2, or FIG. 8) for establishing and selectively sizing a first fluid flow path (170 of FIG. 2, or 508 of FIG. 8) from said pressure inlet channel to said service channel means, and to a second operating position (FIG. 3, or FIG. 9) for establishing and selectively sizing a second fluid flow path (182 of FIG. 3, or 514 of FIG. 9) from said service channel means to said first branch channel; and flow controlling means (60 or 306), interconnecting said service channel means and said first work port channel, having a flow control plunger (56) that is movable from a free-flow position (FIG. 4, or FIG. 10), and having first (173 or 332) and second (175 or 334) fluid responsive operators, for selectively controlling the rate of fluid flow from said pressure inlet channel to said first work port channel in response to fluid pressures in said pressure inlet channel and said service channel means being applied to separate ones of said fluid responsive operators, and for selectively controlling the rate of fluid flow from said first work port channel to said first branch channel in response to fluid pressures in said service channel means and said return port means being applied to separate ones of said fluid responsive operators.

5. A fluid flow controlling device as claimed in claim 4 in which said device includes control logic means (110 or 412), comprising a control port (212 or 436), comprising cooperating portions (88 & 94, or 364 & 366) of said valving element means (55 or 366), and comprising a one-way flow valve (214, 421, or 426), for communicating said control port with said first work port channel when said valving element means is in said first operating position, for communicating said first work port channel to a source (24 of FIG. 1) of pressurized fluid to control the effective output of said source by connection of said control port thereto, and for preventing fluid flow from said first work port channel to said control port.

6. A fluid flow controlling device as claimed in claim 4 in which said body includes a spool bore (38) and said valving element means comprises a valve spool (55) being slidably fitted into said spool bore;

said pressure inlet channel, said service channel means, and said first branch channel intercept said spool bore in spaced-apart and sequential array;

said application of said pressures to one of said fluid responsive operators comprises a signal passage (62 or 64) intercepting said bore intermediate of said service channel means and an adjacent one (48 or 50) of said channels, and communicating with one of said fluid responsive operators;

said valve spool includes first (76) and second (74 or 78) cylindrical land portions each having a cylindrical surface and being separated by a reduced cross-section portion (82 or 84);

said service channel means (42) and said signal passage (62 or 64) are selectively communicated with said one (48 or 40) channel by said reduced cross-section portion;

said selective communications between said service channel means and said one channel and between said signal passage and said one channel are selectively blocked by said first cylindrical land portion;

said one land portion includes flow notch means comprising two diametrically opposed notches (98*a* and 98*b* of FIG. 1) in said first cylindrical land portion (76) juxtaposed to said reduced cross-section portion (84), for establishing said first fluid flow path (170) by said notch means before said pressure inlet channel is opened to said service channel means by said reduced cross-section portion as said valve spool is moved to establish said fluid flow path; and tang surface means (88 and 90), comprising two diametrically opposed cylindrical surface portions (96*a* and 96*b*) of said cylindrical land portion that are juxtaposed to said reduced cross-section portion and that are circumferentially displaced from said notches, for selectively engaging said spool bore in circumferential and longitudinal portions (172) of said spool bore that encompass said signal passage (64).

7. A fluid flow controlling device as claimed in claim 4 in which said body includes a spool bore (38) and said valving element means comprises a valve spool (55) having a cylindrical land portion (76) and being slidably fitted into said spool bore; and said application of one of said fluid pressures to said one fluid responsive operator (173 or 175 of FIG. 1) further comprises longitudinally extending groove means (102*a*+102*b* of FIG. 1, or 103*a* or FIGS. 2 & 3) in said cylindrical land portion (76).

8. A fluid flow controlling device as claimed in claim 4 in which said flow control plunger is movable from said free-flow position (FIG. 4) to a first flow throttling position (FIG. 2) wherein said flow rates through said first (170 of FIG. 2) and second (182 of FIG. 3) fluid flow paths are controlled;

said fluid flow controlling means includes resilient means (124) for opposing movement of said flow control plunger from said free-flow position to said first flow throttling position; and said application of fluid pressures in said service channel means to said fluid responsive operators comprises applying fluid pressure from said service channel means to said second fluid responsive operator (175) for said controlling of said rate of fluid flow through said first fluid flow path and comprises applying fluid pressure from said service channel means to said first fluid responsive operator (173) for said controlling of said rate of fluid flow through said second fluid flow path.

9. A fluid flow controlling device as claimed in claim 4 in which said device includes a second work port channel (322);

said valving element means (404) communicates said second work port channel with said pressure inlet channel (316) when said valving element means is in said second operating position;

said valving element means is movable to a float position (FIG. 10) wherein said first (320) and second (322) work port channels are both communicated with said return port means (326+468); and said device includes inactivating means (384+382+502*a*) for inactivating said flow controlling means when said valving element means is in said float position.

10. A fluid flow controlling device as claimed in claim 9 in which said inactivating means comprises cooperating portions (384+382+502*a*) of said valving element means (404) for intercommunicating said first (332) and second (334) fluid responsive operators when said valving element means is in said float position (FIG. 10).

11. In a fluid flow controlling device (22 of FIG. 1, or 400 of FIG. 8) of the type having a body (36 or 398), having a pressure inlet channel (40 or 314), a return channel (50 or 326), a transfer channel (48 or 456), and first (44 or 320) and second (46 or 322) work port channels in said body, and having selective communication means in said body, for selectively communicating said pressure inlet channel with said first work port channel and said second work port channel, for selectively communicating said first work port channel with said transfer channel, and for transferring fluid from said first work port channel to said second work port channel when said first work port channel is communicated with said transfer channel, the improvement in which said selective communication means comprises:

one-way flow means (206 or 460) for communicating said transfer channel to said second work port channel and for preventing fluid flow from said second work port channel to said transfer channel;

service channel means (42 or 218), in said body being interposed intermediate of said pressure inlet channel and said transfer channel, for receiving fluid from said pressure inlet channel and for returning fluid to said transfer channel;

a selectively positionable valving element (54 or 404), communicating with said pressure inlet channel, with said return port means, with said service channel means, with said transfer channel, and with said second work port channel, being movable to a stand-by position wherein said pressure inlet channel is isolated from said first work port channel, being movable to a first operating position (FIG. 2 or FIG. 8) wherein a first fluid flow path (170 or 316) from said pressure inlet channel to said serivce channel means is established and selectively sized, and being movable to a second operating position (FIG. 3 or FIG. 9) wherein a second fluid flow path (182 or 514) from said service channel means to said transfer channel is established and selectively sized; and flow controlling means (60 or 306), interconnecting said service channel means and said first work port channel, having a flow control plunger (56) that is movable from a free-flow position (FIG. 4, or FIG. 10), and having first (173 or 332) and second (175 or 334) fluid responsive operators, for selectively controlling the rate of fluid flow from said pressure inlet channel to said first work port channel in response to fluid pressures in said pressure inlet channel and said service channel means being applied to separate ones of said fluid responsive operators, and for selectively controlling the rate of fluid flow from said first work port channel to said first branch channel in response to fluid pressures in said service channel means and said return port means being applied to separate ones of said fluid responsive operators.

12. A fluid flow controlling device as claimed in claim 11 in which said movable valving element is movable to a regenerative lowering position (FIG. 3 or FIG. 10) wherein said first work port channel (44 or 320) is communicated with said transfer channel (48 or 456).

13. A fluid flow controlling device as claimed in claim 11 in which said movable valving element is movable to a regenerative and power lowering position wherein said first work port channel is communicated with said transfer channel, and wherein said pressure inlet channel is communicated (via 518 of FIG. 9) with said second work port channel.

14. A fluid flow controlling device as claimed in claim 13 in which said device includes control logic means (110 of FIG. 1, or 412 of FIG. 7), comprising a control port (212 or 436), and comprising cooperating portions of said valving element means, for communicating said control port with said second work port channel when said valving element is in said regenerative and power lowering position, and for communicating said second work port channel to a source (24 of FIG. 1) of pressurized fluid to control the effective output of said source by connection of said control port thereto.

15. In a fluid flow controlling device (22 of FIG. 1) of the type having a body (26) that includes a pressure inlet channel (40), that includes first (44) and second (46) work port channels, and that includes return port means (48+50) with a first branch channel (48, 224, or 456), and having selective communication means in said body for selectively communicating said pressure inlet channel with said first work port channel, and said second work port channel with said return port means, and for selectively communicating said pressure inlet channel with said second work port channel, and said first work port channel with said first branch channel, the improvement in which said selective communication means comprises:

service channel means (42), in said body being interposed both intermediate of and adjacent to said pressure inlet channel and said first branch channel, for receiving fluid from said pressure inlet channel and for returning fluid to said first branch channel;

a selectively positionable valving element (54), communicating with said pressure inlet channel, with said service channel means, with said second work port channel, and with said return port means, being movable to a first operating position wherein a first fluid flow path (170 of FIG. 2) is established and selectively sized between said pressure inlet channel and said service channel means, and wherein said second work port channel is communicated with said return port means, and being movable to a second operating position wherein a second fluid flow path (182 of FIG. 3) is established and selectively sized between said service channel means and said first branch channel, and wherein said pressure inlet channel is communicated with said second work port channel; and flow controlling means (60), interconnecting said service channel means and said first work port channel, having a flow control plunger that is movable in one direction from a free-flow position (FIG. 4) to a flow throttling position (FIG. 2) and that is movable in another direction from said free-flow position to a flow-blocking position (FIG. 3), having resilient bias means (120+124) for resiliently urging said flow control plunger from said flow throttling position to said free-flow position and from said free-flow position to said flow blocking position, having a first fluid responsive operator (178) that actuates said flow control plunger toward said flow throttling position in response to fluid pressure applied thereto, having a second fluid responsive operator (175) that actuates said flow control plunger toward said flow blocking position in response to fluid pressure applied thereto, and having flow signal means (62+64+102*a*) for applying fluid pressure from said pressure inlet channel to said first fluid responsive operator and for applying fluid pressure from said service channel means to said second fluid responsive operator when said first fluid flow path is established, and for applying fluid pressure from said service channel means to said first fluid responsive operator and for applying fluid pressure from said return port means to said second fluid responsive operator when said second fluid flow path is established.

16. A fluid flow controlling device as claimed in claim 15 in which said body includes a spool bore (38) intercepting said pressure inlet channel, said service channel means, said second work port channel, and said return port means;

said valving element is slidably fitted in said spool bore; and said flow signal means comprises one signal passage (64) intercepting said spool bore intermediate of said service channel means and said pressure inlet channel and communicating with said first fluid responsive operator, another signal passage (62) intercepting said bore proximal to said service channel means and distal from said pressure inlet channel and communicating with said second fluid responsive operator, and passage means (102*a* of FIG. 1) in said valve spool for communicating said service channel means with said one signal passage when said valve spool is in said second operating (FIG. 3) position and for communicating said service channel means with said other signal passage when said valve spool is in said first operating (FIG. 2) position.

17. A fluid flow controlling device as claimed in claim 16 in which said valve spool comprises three cylindrical land portions (74, 76, & 78) being separated by respective ones of two reduced cross-section portions (82 & 84);

said flow signal means further comprises tang means (90) being juxtaposed to one (76) of said land portions, being intermediate of said one land portion and the proximal one (84) of said reduced cross-section portions, and providing a pair of oppositely disposed cylindrical surfaces (96*a* and 96*b*), for selectively and sealingly engaging said spool bore at said interception of one (64) of said signal passages and said spool bore;

and said passage means in said valve spool comprises a pair of oppositely disposed and longitudinally extending grooves (102*a* and 102*b*) in said valve spool.

18. A fluid flow controlling device as claimed in claim 16 in which said device includes means (199 of FIG. 3, or 192+66+104*a* of FIG. 3) for reducing the fluid pressure applied to said first fluid responsive operator when said pressure inlet channel is communicated to said second work port channel by said valve spool and the fluid pressure in said second work port is below a predetermined pressure magnitude.

19. A fluid flow controlling device as claimed in claim 18 in which said pressure reducing means comprises communicating (via 192, 66, & 104*a* of FIG. 3) said first fluid responsive operator to said second work port channel.

20. A fluid flow controlling device as claimed in claim 19 in which said communicating of said first fluid responsive operator by said reducing means comprises a third signal passage (66) intercepting said spool bore intermediate of said pressure inlet channel and said second work port channel and communicating with said first fluid responsive operator, a check valve (192) being interposed into said third signal passage intermediate of said spool bore and said first fluid responsive operator and providing one-way fluid communication from said first fluid responsive operator to said spool bore, and a longitudinally extending groove (104*a*) communicating said third signal passage with said second work port channel when said valve spool is in said second operating position (FIG. 3).

21. A fluid flow controlling device as claimed in claim 18 in which said pressure reducing means comprises communicating (via 199 of FIG. 3) said first fluid responsive operator to said pressure inlet channel.

22. A fluid flow controlling device as claimed in claim 21 in which said communicating of said first fluid responsive operator by said pressure reducing means comprises a check valve (199 of FIG. 3) being connected to said one signal passage and to said pressure inlet channel.

23. A fluid flow controlling device (26 of FIG. 1, 302 of FIG. 7, or 400 of FIG. 8) which comprises a body (22, 308, 398);

a spool bore (38, 310, 402) in said body;

return port means, comprising a return port (50 or 326) and comprising a first branch channel (48, 324, or 456), for intercepting said spool bore in spaced-apart locations;

a first work port channel (44 or 320) in said body being isolated from said spool bore;

a second work port channel (46 or 322) intercepting said bore intermediate of said return port and said first branch channel;

a pressure inlet channel (40 or 314) intercepting said spool bore intermediate of said second work port channel and said first branch channel;

service channel means, being intermediate of said pressure inlet channel and said first branch channel and comprising a service channel (42), for receiving fluid from said pressure inlet channel via said spool bore intermediate of said pressure inlet channel and said first branch channel, and for returning fluid to said first branch channel via said spool bore intermediate of said pressure inlet channel and said first branch channel;

a valve spool (55, 312, or 404) being slidably inserted into said spool bore and being movable, from a stand-by position (FIG. 1, or FIG. 7), to a first operating position (FIG. 2, or FIG. 8) wherein a first fluid flow path (170 or 508) is established and selectively sized between said pressure inlet channel and said service channel means, and wherein said second work port channel is communicated with said return port means, and to a second operating position (FIG. 3, or FIG. 9) wherein a second fluid flow path (182 or 514) is established and selectively sized between said service channel means and said return port means;

a flow control plunger bore (52 or 328) in said body intercepting said service channel means and said first work port channel;

a flow control plunger (56 or 330) being slidably fitted into said plunger bore, and being movable to free-flow, flow throttling, and flow blocking positions;

resilient bias means being inserted into said plunger bore and being operatively connected to said flow control plunger for resiliently urging said plunger toward one of said positions thereof;

first (173 or 334) and second (175 or 332) fluid responsive operator means, comprising first and second ends of said flow control plunger and cooperating portions of said body and said plunger bore thereof, for fluid pressure actuation of said flow control plunger to said positions thereof in cooperation with said resilient bias means;

and flow signal means, comprising signal passage means (62+64, or 316+358) that communicates with said first and second fluid responsive operator means and with said spool bore, and comprising cooperating portions (90, 102*a*, etc., or 360, etc.) of said valve spool, for applying the fluid pressures in said pressure inlet channel and said service channel means to separate ones of said fluid responsive operator means and for moving said flow control plunger from said free-flow position when said first fluid flow path is established, and for applying the fluid pressures in said service channel means and said return port means to separate ones of said fluid responsive operator means and for moving said flow control plunger from said free-flow position when said second fluid flow path is established.

24. A fluid flow controlling device as claimed in claim 23 in which said valve spool comprises a cylindrical land portion (76 of FIG. 1, or 370 or FIG. 7) having a cylindrical surface that sealingly engages said spool bore, and a reduced cross-section portion (84 or 380) juxtaposed to said cylindrical land portion;

said signal passage means comprises a signal passage (64 or 428); and said cooperating portions of said valve spool comprise tang means (90 or 390) being formed on said cylindrical land portion and being juxtaposed to said reduced cross-section portion, for selectively blocking and opening said signal passage as said valve spool is moved between one of said operating positions (FIG. 2 or FIG. 9) and said stand-by position (FIG. 1 or FIG. 7).

25. In a fluid flow controlling device (22 of FIG. 1) of the type having a body (36) that includes a pressure inlet channel (40), that includes a first work port channel (44), and that includes return port means (48+50) with a first branch channel (48), and having valving element means (54) in said body for establishing and selectively sizing a first fluid flow path (170) from said pressure inlet channel to said first work port channel when said valving element means is in a first operating position (FIG. 2), and for establishing and selectively sizing a second fluid flow path (182) from said first work port channel to said return port means when said valving element means is in a second operating position (FIG. 3), the improvement which comprises:

flow controlling means (60), being interposed between said valving element means and said first work port channel, having a flow control plunger (56) that includes first (173) and second (175) fluid responsive operators, that is movable in a first direction from a free-flow position (FIG. 4), wherein fluid is free to flow from said first work port channel to said valving element means, to a first flow throttling position (FIG. 2) in response to fluid pressure applied to said first fluid responsive operator, and that is movable in a second direction from said first flow throttling position to said free-flow position in response to fluid pressure applied to said second fluid responsive operator, for control of fluid flow from said pressure inlet channel to said first work port channel by movement of said flow control plunger in said first direction from said free-flow position, and for control of fluid flow from said first work port channel to said return port means by movement of said flow control plunger in said first direction from said free-flow position;

and flow signal means (62+64+102*a*), for applying inlet channel pressure to said first fluid responsive operator and for applying first flow path downstream pressure to said second fluid responsive operator when said valving element means is in said first operating position, and for applying second flow path upstream pressure to said first fluid responsive operator and for applying return port means pressure to said second fluid responsive operator when said valving element means is in said second operating position; whereby the rate of fluid flow from said pressure inlet channel to said first work port channel is controlled by said flow control plunger in proportion to said selective sizing of said first fuid flow path, the rate of fluid flow from said first work port channel to said return port means is controlled by said flow control plunger in proportion to said selective sizing of said second fluid flow path, and both of said fluid flow rates are controlled by movement of said flow control plunger in said first direction from said free-flow position.

26. A fluid flow controlling device as claimed in claim 25 in which said device includes a second work port channel (46);

said valving element means communicates said second work port channel with said return port means (50), when said valving element means is in said first operating position (FIG. 2) and communicates said second work port channel with said pressure inlet channel (40) when said valving element means is in said second operating position (FIG. 3);

said flow control plunger is movable from said free-flow position (FIG. 4) to a second flow throttling position (FIG. 5) that is proximal to said free-flow position and that is distal from said first flow throttling position (FIG. 2); and said device includes anticavitation means, comprising said flow control plunger and said second flow throttling position, and comprising means for reducing the fluid pressure in said first fluid responsive operator (173) by fluid flow to said second work port channel, for actuating said flow control plunger to said second flow throttling position when both said valving element means is in said second operating position and the fluid pressure in said first responsive operator exceeds the fluid pressure in said second work port channel.

27. A fluid flow controlling device as claimed in claim 26 in which said anticavitation means further comprises second resilient means (120) for resiliently urging said flow control plunger to said second flow throttling position (FIG. 5); and said fluid pressure reducing means of said anticavitation means comprises both a one-way flow valve (192) and a cooperating portion (104*a*) of said valving element means.

28. A fluid flow controlling device as claimed in claim 25 in which said flow control plunger is movable from said free-flow position (FIG. 4) to a first flow blocking position (FIG. 1) that is proximal to said first flow throttling position (FIG. 2) and distal from said free-flow position; and said device includes load holding means, comprising means (102*a*+64 of FIG. 1, or 101+64+107*b* of FIG. 3) for pressurizing said first fluid responsive operator (173) by fluid that is blocked by said valving element means (54) from flowing from said first work port channel (44) to said return port means (48), and for actuating said flow control plunger to said first flow blocking position when said valving element means is in said stand-by position (FIG. 1).

29. A fluid flow controlling device as claimed in claim 28 in which said valving element means comprises a cylindrical land portion (76); and said pressurizing means comprises a longitudinally extending groove (102*a*) in said cylindrical land portion.

30. A fluid flow controlling device as claimed in claim 25 in which said flow control plunger is movable from said free-flow position (FIG. 4) to a second flow blocking position (FIG. 3) that is proximal to said free-flow position and distal from said first flow throttling position (FIG. 2); and said device includes load check means, comprising resilient means (120) for resiliently urging said flow control plunger from said free-flow position to said second flow blocking position, for moving said flow control plunger to said second flow blocking position when both said first fluid flow path (170 of FIG. 2) is established and fluid pressure in said pressure inlet channel (40) does not exceed said first flow path downstream pressure by a predetermined minimum pressure magnitude.

31. A fluid flow controlling device as claimed in claim 30 in which said applying of said first flow path downstream pressure to said second fluid responsive operator (175) comprises a fluid restrictor (158); and said device includes load check opening means, comprising said fluid restrictor (158), and comprising a one-way flow valve (134) that communicates said second fluid responsive operator to said first work port channel (44), for producing a differential pressure between said first flow path downstream pressure and fluid pressure in said second fluid responsive operator by fluid flow to said second fluid responsive operator via said flow restrictor and by fluid flow from said second fluid responsive operator to said first work port channel via said oneway flow valve, when said valving element means is in said first operating position (FIG. 2) and said first flow path downstream pressure exceeds the fluid pressure in said first work port channel.

32. In a fluid flow controlling device (22 of FIG. 1) of the type having a body (36) that includes a pressure inlet channel (40), that includes a first work port channel (44), and that includes return port means (48+50) with a first branch channel (48), and having valving element means (54) in said body for establishing and selectively sizing a first fluid flow path (170) from said pressure inlet channel to said first work port channel when said valving element means is in a first operating position (FIG. 2), and for establishing and selectively sizing a second fluid flow path (182) from said first work port channel to said return port means when said valving element means is in a second operating position (FIG. 3), the improvement which comprises:

flow controlling means (60), being interposed between said valving element means and said first work port channel, having a flow control plunger (56) that includes first (173) and second (175) fluid responsive operators, that is movable in a first direction from a free-flow position (FIG. 4), wherein fluid is free to flow from said first work port channel to said valving element means, to a first flow throttling position (FIG. 2) in response to fluid pressure applied to said first fluid responsive operator, and that is movable in a second direction from said first flow throttling position to said free-flow position in response to fluid pressure applied to said second fluid responsive operator, for control of fluid flow from said pressure inlet channel to said first work port channel by movement of said flow control plunger in said first direction from said free-flow position, and for control of fluid flow from said first work port channel to said return port means by movement of said flow control plunger in said first direction from said free-flow position;

flow signal means (62+64+102*a*), for applying inlet channel pressure to said first fluid responsive operator and for applying first flow path downstream pressure to said second fluid responsive operator when said valving element means is in said first operating position, and for applying second flow path upstream pressure to said first fluid responsive operator and for applying return port means pressure to said second fluid responsive operator when said valving element means is in said second operating position, whereby said flow control plunger is moved in said first direction from said free-flow position for control of fluid flow through both of said fluid flow paths; and means (120 and/or 175, and 128 and/or 173) for moving said flow control plunger in said second direction from said free-flow position (FIG. 4) to a second flow throttling position (FIG. 5), and for moving said flow control plunger from said second flow throttling position to said free-flow position.

33. In a fluid flow controlling device (22 of FIG. 1) of the type having a body (36) that includes a pressure inlet channel (44), that includes a first work port channel (44), and that includes return port means (48+50) with a first branch channel (48), and having valving element means (54) in said body for establishing and selectively sizing a first fluid flow path (170) from said pressure inlet channel to said first work port channel when said valving element means is in a first operating position (FIG. 2), and for establishing and selectively sizing a second fluid flow path (182) from said first work port channel to said return port means when said valving element means is in a second operating position (FIG. 3), the improvement which comprises:

flow controlling means (60), being interposed between said valving element means and said first work port channel, having a flow control plunger (56) that includes first (173) and second (175) fluid responsive operators, that is movable in a first direction from a free-flow position (FIG. 4), wherein fluid is free to flow from said first work port channel to said valving element means, to a first flow throttling position (FIG. 2) in response to fluid pressure applied to said first fluid responsive operator, and that is movable in a second direction from said first flow throttling position to said free-flow position in response to fluid pressure applied to said second fluid responsive operator, for control of fluid flow from said pressure inlet channel to said first work port channel by movement of said flow control plunger in said first direction from said free-flow position, and for control of fluid flow from said first work port channel to said return port means by movement of said flow control plunger in said first direction from said free-flow position;

flow signal means (62+64+102*a*), for applying inlet channel pressure to said first fluid responsive operator and for applying first flow path downstream pressure to said second fluid responsive operator when said valving element means is in said first operating position, and for applying second flow path upstream pressure to said first fluid responsive operator and for applying return port means pressure to said second fluid responsive operator when said valving element means is in said second operating position, whereby said flow control plunger is moved in said first direction from said free-flow position for control of fluid flow through both of said fluid flow paths;

means (120+124) for resiliently urging said flow control plunger in said second direction from said first flow throttling position (FIG. 2) to said free-flow position (FIG. 4), and for resiliently urging said flow control plunger in said second direction from said free-flow position to a second flow throttling position (FIG. 5); and means (128 and/or 173) for moving said flow control plunger from said second flow throttling position (FIG. 5) toward said free-flow position.

34. A fluid flow controlling device as claimed in claim 33 in which said flow control plunger is movable from said free-flow position (FIG. 4) to a second flow blocking position (FIG. 3) that is proximal to said free-flow position and distal from said first flow throttling position (FIG. 2); and said device includes load lock means (199+120) for reducing fluid pressure in said first fluid responsive operator (173) and for actuating said flow control plunger to said second flow blocking position when both said valving element means is in said second operating position (FIG. 3) and fluid pressure in said pressure inlet channel (40) is below a predetermined minimum.

35. A fluid flow controlling device as claimed in claim 34 in which said means for reducing fluid pressure in said first fluid responsive operator (173) comprises a one-way flow valve (139) communicating said first fluid responsive operator to said pressure inlet channel (40).

36. A fluid flow controlling device as claimed in claim 33 in which said device includes a second work port channel (46);

said valving element means communicates said second work port channel with said return port means (50) when said valving element means is in said first operating position (FIG. 2) and communicates said second work port channel with said pressure inlet channel (40) when said valving element means is in said second operating position (FIG. 3);

said flow control plunger is movable from said free-flow position (FIG. 4) to a second flow blocking position (FIG. 3) that is proximal to said free-flow position and distal from said first flow throttling position (FIG. 2); and said device includes load lock means (192+104*a*+120) for reducing fluid pressure in said first fluid responsive operator (173) and for actuating said flow control plunger to said second flow blocking position when both said valving element means is in said second operating position (FIG. 3) and fluid pressure in said second work port channel is below a predetermined minimum pressure.

37. A fluid flow controlling device as claimed in claim 36 in which said means for reducing fluid pressure in said first fluid responsive operator (173) comprises a one-way flow valve (192) and a cooperating portion (104*a*) of said valving element means.

38. A fluid flow controlling device as claimed in claim 33 in which said flow control plunger is movable from said free-flow position (FIG. 4) to a second flow blocking position (FIG. 3) that is proximal to said free-flow position and distal from said first flow throttling position (FIG. 2);

said device includes resilient means (120) for resiliently urging said flow control plunger from said free-flow position to said second flow blocking position; and said device further includes load lock opening means, comprising a shuttle piston (128), for actuating said flow control plunger from said second flow blocking position to said free-flow position.

39. A fluid flow controlling device as claimed in claim 33 in which said device includes a second work port channel (46);

said valving element means communicates said second work port channel with said return port means (50) when said valving element means is in said first operating position (FIG. 2) and communicates said second work port channel with said pressure inlet channel (40) when said valving element means is in said second operating position (FIG. 3);

said flow control plunger is movable from said free-flow position (FIG. 4) to a second flow blocking position (FIG. 3) that is proximal to said free-flow position and distal from said first flow throttling position FIG. 2);

said device includes resilient means (120) for resiliently urging said flow control plunger from said free-flow position to said second flow blocking position; and said device further includes load lock opening means (130) being responsive to fluid pressure in said second work port channel, for actuating said flow control plunger from said second flow blocking position to said free-flow position when both said valving element means is moved to said second operating position and fluid pressure in said second work port channel exceeds a predetermined minimum pressure magnitude.

40. In a fluid flow controlling device (22 of FIG. 1) of the type having a body (36) that includes a pressure inlet channel (40), that includes first (44) and second (46) work port channels, and that includes return port means (48+50) with a first branch channel (48), and having valving element means (54) in said body for both establishing and selectively sizing a first fluid flow path (170) from said pressure inlet channel to said first work port channel and communicating said second work port channel to said return port means when said valving element means is in a first operating position (FIG. 2), and for both establishing and selectively sizing a second fluid flow path (182) from said first work port channel to said first branch channel and communicating said pressure inlet channel to said second work port channel when said valving element means is in a second operating position (FIG. 3), the improvement which comprises:

flow controlling means (60), being interposed between said valving element means and said first work port channel, having a flow control plunger (56) that includes first (173) and second (175) fluid responsive operators, that is movable in a first direction from a free-flow position (FIG. 4), wherein fluid is free to flow from said first work port channel to said valving element means, to a first flow throttling position (FIG. 2) in response to fluid pressure applied to said first fluid responsive operator, and that is movable in a second direction from said first flow throttling position to said free-flow position in response to fluid pressure applied to said second fluid responsive operator, for control of fluid flow from said pressure inlet channel to said first work port channel by movement of said flow control plunger from said free-flow position, and for control of fluid flow from said first work port channel to said return port means by movement of said flow control plunger from said free-flow position;

flow signal means (62 +64+102*a*), for applying inlet channel pressure and said first flow path downstream pressure to separate ones of said fluid responsive operators when said valving element means is in said first operating position, and for applying second flow path upstream pressure and return port means pressure to separate ones of said fluid responsive operators when said valving element means is in said second operating position; and anticavitation means, comprising said flow control plunger, for throttling (FIG. 5) fluid flow from said first work port channel (44) to said return port means (48 or 50) in response to a reduction in fluid pressure in said second work port channel below a predetermined minimum pressure when said valving element means is in said second operating position and said second fluid flow path (182 of FIG. 3) is established thereby, whereby fluid flow from said first work port channel to said return port means is controlled by a reduction in fluid pressure in said second work port channel below said predetermined minimum.

41. A fluid flow controlling device as claimed in claim 40, in which said valving element means is movable to a stand-by position wherein said first work port channel is isolated from both said pressure inlet channel and said return port means; and said device includes load holding means, comprising said flow control plunger, for blocking (FIG. 1) fluid flow from said first work port channel (44) to said return port means (48 or 50) in response to fluid pressure in said first work port channel that is isolated from said return port means when said valving element means is in said stand-by position (FIG. 1), whereby said flow control plunger and said valving element means cooperate to minimize fluid leakage from said first work port channel to said return port means (48+50) when said valving element means is in said stand-by position.

42. A fluid flow controlling device as claimed in claim 40 in which said device includes load lock means, comprising said flow control plunger, for blocking (FIG. 3) fluid flow from said first work port channel (44) to said return port means (48 or 50) when both said second fluid flow path (182 of FIG. 3) is established and a predetermined minimum fluid pressure is not maintained in said pressure inlet channel (40), whereby fluid can not be returned from said first work port channel to said return port means without maintaining fluid pressure in said pressure inlet channel at or above said predetermined minimum.

43. A fluid flow controlling device as claimed in claim 40 in which said device includes load check means, comprising said flow control plunger, for blocking (FIG. 3) fluid flow from said first work port channel (44) to said pressure inlet channel (40) when both said first fluid flow path (170 of FIG. 2) is established and fluid pressure in said pressure inlet channel does not exceed said first flow path downstream pressure by a predetermined minimum.

44. In a fluid flow controlling device (22 of FIG. 1) of the type having a body (36) that includes a pressure inlet channel (40), that includes a first work port channel (44), and that includes return port means (48+50) with a first branch channel (48), and having valving element means (54) in said body for establishing and selectively sizing a first fluid flow path (170) from said pressure inlet channel to said first work port channel when said valving element means is in a first operating position (FIG. 2), for establishing and selectively sizing a second fluid flow path (182) from said first work port channel to said return port means when said valving element means is in a second operating position (FIG. 3), and for isolating said first work port channel from said pressure inlet channel and said return port means when said valving element means is in a stand-by position, the improvement which comprises:

flow controlling means (60), being interposed between said valving element means and said first work port channel, having a flow control plunger (56) that includes first (173) and second (175) fluid responsive operators, that is movable in a first direction from a free-flow position (FIG. 4), wherein fluid is free to flow from said first work port channel to said valving element means, to a first flow throttling position (FIG. 2) in response to fluid pressure applied to said first fluid responsive operator, and that is movable in a second direction from said first flow throttling position to said free-flow position in response to fluid pressure applied to said second fluid responsive operator, for control of fluid flow from said pressure inlet channel to said first work port channel by movement of said flow control plunger from said free-flow position, and for control of fluid flow from said first work port channel to said return port means by movement of said flow control plunger from said free-flow position;

flow signal means (62+64+102*a*), for applying inlet channel pressure and first flow path downstream pressure to separate ones of said fluid responsive operators when said valving element means is in said first operating position, and for applying second flow path upstream pressure and return port means pressure to separate ones of said fluid responsive operators when said valving element means is in said second operating position;

means (120+124) for resiliently urging said flow control plunger in said second direction from said first flow throttling position (FIG. 2) to said free-flow position (FIG. 4), and for resiliently urging said flow control plunger in said second direction from said free-flow position to a second flow throttling position (FIG. 5); and said device includes load holding means, comprising said flow control plunger, for blocking (FIG. 1) fluid flow from said first work port channel (44) to said return port means (48 or 50) in response to fluid pressure in said first work port channel that is isolated from said return port means (48 or 50) when said valving element means is in said stand-by position (FIG. 1), whereby said flow control plunger and said valving element means cooperate to minimize fluid leakage from said first work port channel to said return port means (48+50) when said valving element means is in said stand-by position.

45. A fluid flow controlling device as claimed in claim 44 in which said device includes load lock means, comprising said flow control plunger, for blocking (FIG. 3) fluid flow from said first work port channel (44) to said return port means (48 or 50) when both said second fluid flow path (182 of FIG. 3) is established and a predetermined minimum fluid pressure is not maintained in said pressure inlet channel (40), whereby fluid cannot be returned from said first work port channel to said return port means without maintaining fluid pressure in said pressure inlet channel at or above said predetermined minimum.

46. A fluid flow controlling device as claimed in claim 44 in which said device includes a second work port channel (46);

said valving element means communicates said second work port channel with said return port means (50) when said valving element means is in said first operating position (FIG. 2) and communicates said second work port channel with said pressure inlet channel (40) when said valving element means is in said second operating position (FIG. 3); and anticavitation means, comprising said flow control plunger, for throttling (FIG. 5) fluid flow from said first work port channel (44) to said return port means (48 or 50) in response to a reduction in fluid pressure in said second work port channel below a predetermined minimum pressure when said valving element means is in said second operating position and said second fluid flow path (182 of FIG. 3) is established thereby, whereby fluid flow from said first work port channel to said return port means is controlled by a reduction in fluid pressure in said second work port channel below said predetermined minimum.

47. In a fluid flow controlling device (22 of FIG. 1) of the type having a body (36) that includes a pressure inlet channel (40), that includes a first work port channel (44), and that includes return port means (48+50) with a first branch channel (48), and having valving element means (54) in said body for establishing and selectively sizing a first fluid flow path (170) from said pressure inlet channel to said first work port channel when said valving element means is in a first operating position (FIG. 2), and for establishing and selectively sizing a second fluid flow path (182) from said first work port channel to said return port means when said valving element means is in a second operating position (FIG. 3), the improvement which comprises:

flow controlling means (60), being interposed between said valving element means and said first work port channel, having a flow control plunger (56) that includes first (173) and second (175) fluid responsive operators, that is movable in a first direction from a free-flow position (FIG. 4), wherein fluid is free to flow from said first work port channel to said valving element means, to a first flow throttling position (FIG. 2) in response to fluid pressure applied to said first fluid responsive operator, and that is movable in a second direction from said first flow throttling position to said free-flow position in response to fluid pressure applied to said second fluid responsive operator, for control of fluid flow from said pressure inlet channel to said first work port channel by movement of said flow control plunger from said free-flow position, and for control of fluid flow from said first work port channel to said return port means by movement of said flow control plunger from said free-flow position;

flow signal means (62+64+102*a*), for applying inlet channel pressure and first flow path downstream pressure to separate ones of said fluid responsive operators when said valving element means is in said first operating position, and for applying second flow path upstream pressure and return port means pressure to separate ones of said fluid responsive operators when said valving element means is in said second operating position; and said device includes load lock means, comprising said flow control plunger, for blocking (FIG. 3) fluid flow from said first work port channel (44) to said return port means (48 or 50) when both said second fluid flow path (182 of FIG. 3) is established and a predetermined minimum fluid pressure is not maintained in said pressure inlet channel (40), whereby fluid cannot be returned from said first work port channel to said return port means without maintaining fluid pressure in said pressure inlet channel at or above said predetermined minimum.

48. A fluid flow controlling device as claimed in claim 47 in which said valving element means is movable to a stand-by position wherein said first work port channel is isolated from both said pressure inlet channel and said return port means; and said device includes load holding means, comprising said flow control plunger, for blocking (FIG. 1) fluid flow from said work port channel (44) to said return port means (48 or 50) in response to fluid pressure in said first work port channel (44) that is isolated from said return port means when said valving element means is in said stand-by position (FIG. 1), whereby said flow control plunger and said valving element means cooperate to minimize fluid leakage from said first work port channel to said return port means (48+50) when said valving element means is in said stand-by position.

49. A fluid flow controlling device as claimed in claim 48 in which said device includes a second work port channel (46);

said valving element means communicates said second work port channel with said return port means (50) when said valving element means is in said first operating position (FIG. 2) and communicates said second work port channel with said pressure inlet channel (40) when said valving element means is in said second operating position (FIG. 3); and anticavitation means, comprising said flow control plunger, for throttling (FIG. 5) fluid flow from said first work port channel (44) to said first branch channel (48) in response to a reduction in fluid pressure in said second work port channel below a predetermined minimum pressure when said valving element means is in said second operating position and said second fluid flow path (182 of FIG. 3) is established thereby, whereby fluid flow from said first work port channel to said first branch channel is controlled by a reduction in fluid pressure in said second work port channel below said predetermined minimum.

50. A fluid flow controlling device as claimed in claim 47 in which said device includes load check means, comprising said flow control plunger, for blocking (FIG. 3) fluid flow from said first work port channel (44) to said pressure inlet channel (40) when both said first fluid flow path (170 of FIG. 2) is established and fluid pressure in said pressure inlet channel does not exceed said first flow path downstream pressure by a predetermined minimum.

51. A fluid flow controlling device as claimed in claim 50 in which said device includes a second work port channel (46);

said valving element means communicates said second work port channel with said return port means (50) when said valving element means is in said first operating position (FIG. 2) and communicates said second work port channel with said pressure inlet channel (40) when said valving element means is in said second operating position (FIG. 3); and anticavitation means, comprising said flow control plunger, for throttling (FIG. 5) fluid flow from said first work port channel (44) to said return port means (48 or 50) in response to a reduction in fluid pressure in said second work port channel below a predetermined minimum pressure when said valving element means is in said second operating position and said second fluid flow path (182 of FIG. 3) is established thereby, whereby fluid flow from said first work port channel to said return port means is controlled by a reduction in fluid pressure in said second work port channel below said predetermined minimum.

52. In a fluid flow controlling device (22 of FIG. 1) of the type having a body (36) that includes a pressure inlet channel (40), that includes a first work port channel (44), and that includes return port means (48+50) with a first branch channel (48), and having valving element means (54) in said body for establishing and selectively sizing a first fluid flow path (170) from said pressure inlet channel to said first work port channel when said valving element means is in a first operating position (FIG. 2), and for establishing and selectively sizing a second fluid flow path (182) from said first work port channel to said return port means when said valving element means is in a second operating position (FIG. 3), the improvement which comprises:

flow controlling means (60), being interposed between said valving element means and said first work port channel, having a flow control plunger (56) that includes first (173) and second (175) fluid responsive operators, that is movable in a first direction from a free-flow position (FIG. 4), wherein fluid is free to flow from said first work port channel to said valving element means, to a first flow throttling position (FIG. 2) in response to fluid pressure applied to said first fluid responsive operator, and that is movable in a second direction from said first flow throttling position to said free-flow position in response to fluid pressure applied to said second fluid responsive operator, for control of fluid flow from said pressure inlet channel to said first work port channel by movement of said flow control plunger from said free-flow position, and for control of fluid flow from said first work port channel to said return port means by movement of said flow control plunger from said free-flow position;

flow signal means (62+64+102*a*), for applying inlet channel pressure to said first fluid responsive operator and for applying first flow path downstream pressure to said second fluid responsive operator when said valving element means is in said first operating position, and for applying second flow path upstream pressure to said first fluid responsive operator and for applying return port means pressure to said second fluid responsive operator when said valving element means is in said second operating position, whereby said flow control plunger is moved in said first direction from said free-flow position for control of fluid flow through both of said flow flow paths;

means (120+124) for resiliently urging said flow control plunger in said second direction from said first flow throttling position (FIG. 2) to said free-flow position (FIG. 4), and for resiliently urging said flow control plunger in said second direction from said free-flow position to a second flow throttling position (FIG. 5);

said device includes load check means, comprising said flow control plunger, for blocking (FIG. 3) fluid flow from said first work port channel (44) to said pressure inlet channel (40) when both said first fluid flow path (170 of FIG. 2) is established and fluid pressure in said pressure inlet channel does not exceed said first flow path downstream pressure by a predetermined minimum; and said device includes load lock means, comprising said flow control plunger, for blocking (FIG. 3) fluid flow from said first work port channel (44) to said return port means (48 or 50) when both said second fluid flow path (182 of FIG. 3) is established and a predetermined minimum fluid pressure is not maintained in said pressure inlet channel (40), whereby fluid cannot be returned from said first work port channel to said return port means without maintaining fluid pressure in said pressure inlet channel at or above said predetermined minimum.

53. In a hydraulic system of the type having a pump, having a sump that is connected to said pump, having a fluid motor that includes first and second motor ports, and having a directional control valve (400 of FIG. 10) that includes a pressure inlet channel (316) connected to said pump, that includes first (320) and second (322) work port channels connected to respective ones of said motor ports, that includes return port means (326+468) for returning excess fluid to said sump, and that includes movable valving element means (404) for isolating said pressure inlet channel from said work port channels when said valving element means is in a stand-by position (FIG. 7), for establishing and selectively sizing a first fluid flow path (316) from said pressure inlet channel to said first work port channel and for communicating said second work port channel to said return port means when said valving element is in a first operating position (FIG. 8), and for establishing and selectively sizing a second fluid flow path (514) from said first work port channel to said return port means and for communicating said pressure inlet channel to said second work port channel when said valving element means is in a second operating position, the improvement which comprises:

flow controlling means (306), being interposed into said directional control valve intermediate of said valving element means and said first work port channel, and having a flow control plunger (330) that is movable from a free-flow position (FIG. 10), for control of the rate of fluid flow through said first fluid flow path in response to said selective sizing thereof, and for control of the rate of fluid flow through said second fluid flow path in response to said selective sizing thereof;

said valving element means is movable to a float position (FIG. 10) wherein said first (320) and second (322) work port channels are both communicated with said return port means (326+468); and said device includes inactivating means (384+382+502*a*) for inactivating said flow controlling means when said valving element means is in said float position.

54. A hydraulic system as claimed in claim 53 in which said inactivating means comprises cooperating portions (384+382+502*a*) of said valving element means (404 for intercommunicating said first (332) and second (334) fluid responsive operators when said valving element means is in said float position (FIG. 10).

55. In a hydraulic system of the type having a pmp (26), having a sump (28) that is connected to said pump, having a fluid motor (34) that includes first (164) and second (176) motor ports, and having a directional control valve (58) that includes a pressure inlet channel (40) connected to said pump, that includes first (44) and second (46) work port channels connected to respective ones of said motor ports, that includes return port means (48+50) for returning excess fluid to said sump, and that includes movable valving element means (54) for isolating said pressure inlet channel from said work port channels when said valving element means is in a stand-by position (FIG. 1), for establishing and selectively sizing a first fluid flow path (170 of FIG. 2) from said pressure inlet channel to said first work port channel and for communicating said second work port channel to said return port means when said valving element means is in a first operating position (FIG. 2), and for establishing and selectively sizing a second fluid flow path (182 of FIG. 3) from said first work port channel to said return port means and for communicating said pressure inlet channel to said second work port channel when said valving element means is in a second operating position (FIG. 3), the improvement which comprises:

flow controlling means (60), being interposed into said directional control valve intermediate of said valving element means and said first work port channel, and having a flow control plunger (56) that is movable from a free-flow position (FIG. 4), for control of the rate of fluid flow through said first fluid flow path in response to said selective sizing thereof, and for control of the rate of fluid flow through said second fluid path in response to said selective sizing thereof;

and anticavitation means (192+104*a*+120+56 of FIG. 3), comprising said flow control plunger, for sensing the fluid pressure in said second work port channel and for further limiting the rate of fluid flow from said first motor port to said return port means via said second fluid flow path (182 of FIG. 3) in response to said sensed pressure to whatever flow rate is necessary to maintain a predetermined minimum fluid pressure in said second work port channel when said movable valving element means is in said second operating position (FIG. 3).

56. A hydraulic system as claimed in claim 55 in which said improvement further comprises load check means (130*a*+62+120 of FIG. 2) for moving said flow control plunger to a flow blocking position (FIG. 3) when said movable valving element means is in said first operating position (FIG. 2) and fluid pressure in said first work port channel equals or exceeds the fluid pressure in said pressure inlet channel.

57. In a hydraulic system of the type having a pump (26), having a sump (28) that is connected to said pump, having a fluid motor (34) that includes a first motor port (164), and having a directional control valve (58) that includes a pressure inlet channel (40) connected to said pump, that includes a first work port channel (44) connected to said first motor port, that includes return port means (48+50) for returning excess fluid to said sump, and that includes movable valving element means (54) for isolating said pressure inlet channel from said work port channel when said valving element means is in a stand-by position (FIG. 1), for establishing and selectively sizing a first fluid flow path (170 of FIG. 2) from said pressure inlet channel to said first work port channel when said valving element means is in a first operating position (FIG. 2), and for establishing and selectively sizing a second fluid flow path (182 of FIG. 3) from said first work port channel to said return port means when said valving element means is in a second operating position (FIG. 3), the improvement which comprises:

flow controlling means (60), being interposed into said directional control valve intermediate of said valving element means and said first work port channel, and having a flow control plunger (56) that is movable from a free-flow position (FIG. 4), for control of the rate of fluid flow through said first fluid flow path in response to said selective sizing thereof, and for control of the rate of fluid flow through said second fluid flow path in response to said selective sizing thereof;

and load holding means (102*a*+64+173+56 of FIG. 1, or 101+64+107*b*+173+56 of FIG. 3), comprising said flow control plunger, for blocking fluid communication from said first work port channel to said return port means when said movable valving element means is in said stand-by position (FIG. 1), and fluid pressure in said first motor port pressurizes said first work port channel.

58. A hydraulic system as claimed in claim 57 in which said improvement further comprises load lock means (192+104a+120 of FIG. 3, or 107b+199+120 of FIG. 3) for moving said flow control plunger to a flow blocking position (FIG. 3) when both said second fluid flow path (182 of FIG. 3) is established and a predetermined minimum fluid pressure is not maintained in said pressure inlet channel.

59. A hydraulic system as claimed in claim 57 in which said fluid motor includes a second motor port (176), said directional control valve includes a second work port channel (46) that is connected to said second motor port, and said pressure inlet channel is communicated to said second work port channel when said valving element means is in said second operating position; and said improvement further comprises anticavitation means (192+104a+120 of FIG. 3) for moving said flow control plunger to a flow throttling position (FIG. 5), and for limiting the rate of fluid flow from said first motor port (164) through said second fluid flow path (182 of FIG. 3) to whatever flow rate is necessary to maintain a predetermined minimum fluid pressure in said second work port channel (46) when said movable valving element is in said second operating position (FIG. 3).

60. A hydraulic system as claimed in claim 57 in which said improvement further comprises load check means (103a+62+120 of FIG. 2) for moving said flow control plunger to a flow blocking position (FIG. 3) when said movable valving element means is in said first operating position (FIG. 2) and fluid pressure in said first work port channel equals or exceeds the fluid pressure in said pressure inlet channel.

61. A hydraulic system as claimed in claim 60 in which said improvement further comprises load lock means (192+104a+120 of FIG. 3, or 107b+199+120 of FIG. 3) for moving said flow control plunger to a flow blocking position (FIG. 3) when both said second fluid flow path (182 of FIG. 3) is established and a predetermined mininum fluid pressure is not maintained in said pressure inlet channel.

62. A hydraulic system as claimed in claim 60 in which said fluid motor includes a second motor port (176), said directional control valve includes a second work port channel (46) that is connected to said second motor port, and said pressure inlet channel is communicated to said second work port channel when said valving element means is in said second operating position; and said improvement further comprises anticavitation means (192+104a+120 of FIG. 3) for moving said flow control plunger to a flow throttling position (FIG. 5), and for limiting the rate of fluid flow from said first motor port (164) through said second fluid flow path (182 of FIG. 3) to whatever flow rate is necessary to maintain a predetermined minimum fluid pressure in said second work port channel (46) when said movable valving element is in said second operating position (FIG. 3).

63. In a hydraulic system of the type having a pump (26), having a sump (28) that is connected to said pump, having a fluid motor (34) that includes a first motor port (164), and having a directional control valve (58) that includes a pressure inlet channel (40) connected to said pump, that includes a first work port channel (44) connected to said first motor port, that includes return port means (48+50) for returning excess fluid to said sump, and that includes movable valving element means (54) for isolating said pressure inlet channel from said first work port channel when said valving element means is in a stand-by position (FIG. 1), for establishing and selectively sizing a first fluid flow path (170 of FIG. 2) from said pressure inlet channel to said first work port channel when said valving element means is in a first operating position (FIG. 2), and for establishing and selectively sizing a second fluid flow path (182 of FIG. 3) from said first work port channel to said return port means when said valving element means is in a second operating position (FIG. 3), the improvement which comprises:

flow controlling means (60), being interposed into said directional control valve intermediate of said valving element means and said first work port channel, and having a flow control plunger (56) that is movable from a free-flow position (FIG. 4), for control of the rate of fluid flow through said first fluid flow path in response to said selective sizing thereof, and for control of the rate of fluid flow through said second fluid flow path in response to said selective sizing thereof;

and load lock means (107b+199+120+56 of FIG. 3), comprising said flow control plunger, for blocking fluid communication from said first work port channel to said return port means when both said second fluid flow path (182 of FIG. 3) is established and a predetermined minimum fluid pressure is not maintained in said pressure inlet channel.

64. A hydraulic system as claimed in claim 63 in which said blocking of fluid communication comprises a flow blocking position (FIG. 3) to which said flow control plunger is movable;

said flow controlling means includes resilient means (120) for resiliently urging said flow control plunger from said free-flow position to said flow blocking position; and said hydraulic system further comprises load lock opening means (128) for actuating said flow control plunger from said flow blocking position to said free-flow position (FIG. 4) in response to fluid pressure in said pressure inlet channel when said valving element means is in said second operating position (FIG. 3).

65. A hydraulic system as claimed in claim 63 in which said fluid motor includes a second motor port (176), said directional control valve includes a second work port channel (46) that is connected to said second motor port, and said pressure inlet channel is communicated to said second work port channel when said valving element means is in said second operating position; and said improvement further comprising anticavitation means (192+104a+120 of FIG. 3) for moving said flow control plunger to a flow throttling position (FIG. 5), and for limiting the rate of fluid flow from said first motor port (164) through said second fluid flow path (182 of FIG. 3) to whatever flow rate is necessary to maintain a predetermined minimum fluid pressure in said second work port channel (46) when said movable valving element is in said second operating position (FIG. 3).

66. In a hydraulic system of the type having a pump (26), having a sump (28) that is connected to said pump, having a fluid motor (34) that includes first (164) and second (176) motor ports, and having a directional control valve (58) that includes a pressure inlet channel (40) connected to said pump, that includes first (44) and second (46) work port channels connected to respective ones of said motor ports, that includes return port means (48+50) for returning excess fluid to said sump, and that includes movable valving element means (54) for isolating said pressure inlet channel from said work port channels when said valving element means is in a stand-by position (FIG. 1), for establishing and selectively sizing a first fluid flow path (170 of FIG. 2) from said pressure inlet channel to said first work port channel and for communicating said second work port channel to said return port means when said valving element means is in a first operating position (FIG. 2), and for establishing and selectively sizing a second fluid flow path (182 of FIG. 3) from said first work port channel to said return port means and for communicating said pressure inlet channel to said second work port channel when said valving element means is in a second operating position (FIG. 3), the improvement which comprises:

flow controlling means (60), being interposed into said directional control valve intermediate of said valving element means and said first work port channel, and having a flow control plunger (56) that is movable from a free-flow position (FIG. 4), for control of the rate of fluid flow through said first fluid flow path in response to said selective sizing thereof, and for control of the rate of fluid flow through said second fluid flow path in response to said selective sizing thereof; and load lock means (192+104*a*+120+56 of FIG. 3), comprising said flow control plunger, for blocking fluid communication from said first work port channel to said return port means when both said second fluid flow path (182 of FIG. 3) is established and a predetermined minimum fluid pressure is not maintained in said second work port channel.

67. A hydraulic system as claimed in claim 66 in which said blocking of fluid communication comprises a flow blocking position (FIG. 3) to which said flow control plunger is movable;

said flow controlling means includes resilient means (120) for resiliently urging said flow control plunger from said free-flow position to said flow blocking position; and said hydraulic system further comprises load lock opening means, comprising a shuttle piston (128), for actuating said flow control plunger from said flow blocking position to said free-flow position (FIG. 4).

68. A hydraulic system as claimed in claim 66 in which said blocking of fluid communication comprises a flow blocking position (FIG. 3) to which said flow control plunger is movable;

said flow controlling means includes resilient means (120) for resiliently urging said flow control plunger from said free-flow position to said flow blocking position; and said hydraulic system further comprises load lock opening means (128) for actuating said flow control plunger from said flow blocking position to said free-flow position (FIG. 4) in response to fluid pressure in said second work port channel (46) when said valving element means is in said second operating position (FIG. 3).

69. A hydraulic system as claimed in claim 66 in which said improvement further comprises anticavitation means (192+104*a*+120 of FIG. 3) for moving said flow control plunger to a flow throttling position (FIG. 5), and for limiting the rate of fluid flow from said first motor port (164) through said second fluid flow path (182 of FIG. 3) to whatever flow rate is necessary to maintain a predetermined minimum fluid pressure in said second work port channel (46) when said movable valving element means is in said second operating position (FIG. 3).

70. In a hydraulic system of the type having a pump (26), having a sump (28) that is connected to said pump, having a fluid motor (34) that includes a first motor port (164), and having a directional control valve (58) that includes a pressure inlet port (40) connected to said pump, that includes a first work port channel (44) connected to said first motor port, that includes return port means (48+50) for returning excess fluid to said sump, and that includes movable valving element means (54) for isolating said pressure inlet channel from said first work port channel when said valving element means is in a stand-by position (FIG. 1), for establishing and selectively sizing a first fluid flow path (170 of FIG. 2) from said pressure inlet channel to said first work port channel when said valving element means is in a first operating position (FIG. 2), and for establishing and selectively sizing a second fluid flow path (182 of FIG. 3) from said first work port channel to said return port means when said valving element means is in a second operating position (FIG. 3), the improvement which comprises:

flow controlling means (60), being interposed into said directional control valve intermediate of said valving element means and said first work port channel, and having a flow control plunger (56) that is movable from a free-flow position (FIG. 4), for control of the rate of fluid flow through said first fluid flow path in response to said selective sizing thereof, and for control of the rate of fluid flow through said second fluid flow path in response to said selective sizing thereof;

load check means, comprising said flow control plunger, and comprising resilient means (120) for resiliently urging said flow control plunger from said free-flow position to a flow blocking position (FIG. 3), and for blocking fluid communication from said first work port channel to said pressure inlet channel when said valving element means is in said first operating position (FIG. 2) and fluid pressure in said pressure inlet channel does not exceed the fluid pressure in said first work port channel by a predetermined pressure; and load check opening means, comprising first (173) and second (175) fluid responsive operators, and comprising means (158+134) for creating a fluid pressure differential between said fluid responsive operators, for actuating said flow control plunger from said flow blocking position and toward said free-flow position (FIG. 4) when said valving element means is in said first operating position (FIG. 2) and fluid pressure in said pressure inlet channel exceeds the fluid pressure in said first work port channel.

71. A hydraulic system as claimed in claim 70 in which said means for creating a fluid pressure differential comprises a fluid restrictor (158), a one-way flow valve (134), and fluid flow from one of said fluid responsive operators (175) to said first work port channel.

72. A hydraulic system as claimed in claim 70 in which said improvement further comprises load lock means (192+104*a*+120 of FIG. 3, or 107*b*+199+120 of FIG. 3) for moving said flow control plunger to a flow blocking position (FIG. 3) when both said second fluid flow path (182 of FIG. 3) is established and a predetermined minimum fluid pressure is not maintained in said pressure inlet channel.

73. A hydraulic system as claimed in claim 70 in which said fluid motor includes a second motor port (176), said directional control valve includes a second work port channel (46) that is connected to said second motor port, and said pressure inlet channel is communicated to said second work port channel when said valving element means is in said second operating position; and said improvement further comprises anticavitation means (192+104*a*+120 of FIG. 3) for moving said flow control plunger to a flow throttling position (FIG. 5), and for limiting the rate of fluid flow from said first motor port (164) through said second fluid flow path (182 of FIG. 3) to whatever flow rate is necessary to maintain a predetermined minimum fluid pressure in said second work port channel (46) when said movable valving element is in said second operating position (FIG. 3).

74. In a fluid flow controlling device (22 of FIG. 1) of the type having a body (36) that includes a pressure inlet channel (40), that includes a first work port channel (44), and that includes return port means (48+50) with a branch channel (48), and having selectively positionable valving element means (54) in said body that is movable to first and second operating positions, for establishing a bi-directional fluid flow path (170 of FIG. 2) between said pressure inlet channel and said first work port channel when said valving element means is actuated to said first operating position, and for establishing a second fluid flow path (182 of FIG. 3) from said first work port channel to said branch channel when said valving element means is actuated to said second operating position, the improvement which comprises:

flow controlling means (60), comprising a flow control plunger (56) that is interposed into both (170 & 182) of said fluid flow paths and that is movable to a flow-blocking position (FIG. 3) wherein both of said fluid flow paths are blocked by said flow control plunger, for moving said flow control plunger away from said flow blocking position and for establishing bi-directional flow fluid communication between said pressure inlet channel and said first work port channel when both said valving element means is in said first operating position and the magnitude of fluid pressure in said pressure inlet channel exceeds the magnitude of fluid pressure in said first work port channel by a predetermined pressure magnitude, for moving said flow control plunger to said flow-blocking position when said valving element means is in said first operating position and the magnitude of fluid pressure in said pressure inlet channel does not exceed the magnitude of fluid pressure in said first work port channel by said predetermined pressure magnitude, for moving said flow control plunger away from said flow blocking position to a free-flow position (FIG. 4) in response to pressurized fluid supplied by said pressure inlet channel when said valving element means is in said second operating position and thereby communicating said first work port channel with said branch channel, and for moving said flow control plunger to said flow-blocking position when said valving element means is in said second operating position and said pressure inlet channel does not contain pressurized fluid.

75. A fluid flow controlling device as claimed in claim 74 in which said valving element means (54) is effective to selectively size one (170 or 182) of said fluid flow paths; and said flow controlling means (60) is effective for controlling the rate of fluid flow through said one fluid flow path in proportion to said selective sizing thereof.

76. A fluid flow controlling device as claimed in claim 75 in which said one (170 or 182) fluid flow path comprises said bi-directional (170) fluid flow path.

77. A fluid flow controlling device as claimed in claim 75 in which said one (170 or 182) fluid flow path comprises said second (182) fluid flow path.

78. A fluid flow controlling device as claimed in claim 74 in which said movable valving element means (54) is movable to a stand-by position (FIG. 1) wherein fluid flow from said first work port channel (44) to said return port means (48+50) is blocked by said valving element means; and said flow control plunger (56) blocks fluid flow from said first work port channel to said return port means when said valving element means is in said stand-by position; whereby both said valving element means and said flow control plunger block fluid flow from said first work port channel to said return port means when said valving element means is in said stand-by position.

79. A fluid flow controlling device as claimed in claim 74 in which said device includes a second work port channel (46), said valving element means (54) communicates said second work port channel with said return port means (48 or 50) when said valving element means is in said first operating position (FIG. 2), and said valving element means communicates said pressure inlet channel (40) with said second work port channel when said valving element means is in said second operating position (FIG. 3); and said moving of said flow control plunger to said free-flow position (FIG. 4) by pressurized fluid supplied by said pressure inlet channel when said valving element means is in said second operating position comprises both said communicating of said pressure inlet channel with said second work port channel by said valving element means and the fluid pressure in said second work port channel that is produced thereby.

80. A fluid flow controlling device as claimed in claim 79 in which said moving of said flow control plunger (56) to said free-flow position (FIG. 4) by said fluid pressure in said second work port channel (46) comprises a shuttle position (128).

81. A fluid flow controlling device as claimed in claim 80 in which said flow control plunger (56) includes a flow-throttling position (FIG. 5), that is disposed intermediate of said flow-blocking position (FIG. 3) and said free-flow position (FIG. 4); and said flow control plunger is moved from said free-flow position to said flow-throttling position in response to a reduction in fluid pressure in said second work port channel (46) to a predetermined pressure magnitude when said valving element means (54) is in said second operating position (FIG. 3); whereby said flow control plunger is effective to control the rate of fluid flow from said first work port channel (44) to said return port means (48 or 50) as a function of the fluid pressure in said second work port channel (46).

82. A fluid flow controlling device as claimed in claim 79 in which said communication of said first work port channel (44) with said return port means (48 or 50) when said valving element means is in said second operating position (FIG. 3) comprises communication of said first work port channel with said branch channel (48); and said branch channel is communicated to said second work port channel (46) by a conduit (210), fluid flow from said second work port channel to said branch channel is prevented by a one-way flow valve (206) interposed into said conduit, and said device includes means (208) for limiting the fluid pressure in said conduit.

83. A fluid flow controlling device as claimed in claim 74 in which said device includes a second work port channel (46), said valving element means (54) is movable to a regenerative position wherein said first work port channel (44) is communicated to said branch channel 48, said branch channel is communicated to said second work port channel by a conduit (210), fluid flow from said second work port channel to said branch channel is prevented by a one-way flow valve (206) interposed into said conduit, and said device includes means (208) for limiting the fluid pressure in said conduit.

84. In a fluid flow controlling device (22 of FIG. 1) of the type having a body (36) that includes a pressure inlet channel (40), that includes a first work port channel (44), and that includes return port means (48+50) with a branch channel (48), and having selectively positionable valving element means (54) in said body that is movable to first (FIG. 2) and second (FIG. 3) operating positions, for establishing a bi-directional fluid flow path (170 of FIG. 2) between said pressure inlet channel and said first work port channel when said valving element means is actuated to said first operating position, and for establishing a second fluid flow path (182 of FIG. 3) from said first work port channel to said branch channel when said valving element means is actuated to said second operating position, the improvement which comprises:

a flow control plunger (56), being interposed into said body and into both (170 & 186) of said fluid flow paths, being movable in a first direction to a flow-blocking position (FIG. 3) wherein both of said fluid flow paths are blocked, being movable in a second direction away said flow-blocking position, and having first (236) and second (174) fluid responsive areas;

a first fluid responsive operator (175), comprising said first fluid responsive area (236), for moving said flow control plunger in said first direction in response to pressurized fluid applied thereto;

a second fluid responsive operator (173), comprising said second fluid responsive area (174), for moving said flow control plunger in said second direction in response to pressurized fluid applied thereto;

load check opening means, comprising said flow control plunger and said fluid responsive operators, for applying pressurized fluid from said pressure inlet channel to said second fluid responsive operator, for limiting the fluid pressure in said first fluid responsive operator by providing a flow path (132*a*+130+136) to said first work port channel, and for moving said flow control plunger in said second direction to a position wherein bi-directional flow fluid communication is established between said pressure inlet channel and said first work port channel, when the fluid pressure in said pressure inlet channel exceeds the fluid pressure in said first work port channel by a predetermined pressure magnitude and said valving element means is in said first operating position;

load check closing means, comprising said flow control plunger, comprising said first fluid responsive operator, and comprising cooperating portions (103*a*+98*a*+84) of said valving element means, for moving said flow control plunger in said second direction to said flow-blocking position and for preventing fluid flow from said first work port channel to said pressure inlet channel when said valving element means is in said first operating position and the fluid pressure in said pressure inlet channel is less than the fluid pressure in said first work port channel;

return flow means, comprising said flow control plunger, and a cooperating portion (82) of said valving element means, for reducing the pressure magnitude of fluid pressure applied to said first fluid responsive operator, and for actuating said flow control plunger in said second direction to a free-flow position (FIG. 4) wherein said first work port channel is communicated to said branch channel in response to fluid pressure supplied by said pressure inlet channel when said valving element means is in said second operating position; and load lock means, comprising said flow control plunger, comprising said second fluid responsive operator, and comprising a cooperating portion (104*a*) of said valving element means, for reducing the fluid pressure applied to said second fluid responsive operator and for moving said flow control plunger in said first direction to said flow-blocking position when said valving element means is in said second operating position and there is no pressurized fluid in said pressure inlet channel.

85. A fluid flow controlling device as claimed in claim 84 in which said valving element means (54) is effective to selectively size one (170 or 182) of said fluid flow paths;

said flow control plunger is movable to a flow-throttling position (FIG. 2 or FIG. 5); and said flow controlling means (60) is effective for controlling the rate of fluid flow through said one fluid flow path in proportion to said selective sizing of said one fluid flow path by movement of said flow control plunger to said flow-throttling position.

86. A fluid flow controlling device as claimed in claim 85 in which said one (170 or 182) fluid flow path comprises said bi-directional (170) fluid flow path.

87. A fluid flow controlling device as claimed in claim 85 in which said one (170 or 182) fluid flow path comprises said second (182) fluid flow path.

88. A fluid flow controlling device as claimed in claim 84 in which said movable valving element means (54) is movable to a stand-by position (FIG. 1) wherein fluid flow from said first work port channel (44) to said return port means (48+50) is blocked by said valving element means; and said flow control plunger (56) blocks fluid flow from said first work port channel to said return port means when said valving element means is in said stand-by position; whereby both said valving element means and said flow control plunger block fluid flow from said first work port channel to said return port means when said valving element means is in said stand-by position.

89. A fluid flow controlling device as claimed in claim 84 in which said device includes a second work port channel (46), said valving element means (54) communicates said second work port channel with said return port means (48 or 50) when said valving element means is in said first operating position (FIG. 2), and said valving element means communicates said pressure inlet channel (40) with said second work port channel when said valving element means is in said second operating position (FIG. 3); and said moving of said flow control plunger to said free-flow position (FIG. 4) by pressurized fluid supplied by said pressure inlet channel when said valving element means is in said second operating position comprises both said communicating of said pressure inlet channel with said second work port channel by said valving element means and the fluid pressure in said second work port channel that is produced thereby.

90. A fluid flow controlling device as claimed in claim 89 in which said moving of said flow control plunger (56) to said free-flow position (FIG. 45) by said fluid pressure in said second work port channel (46) comprises a shuttle piston (128).

91. A fluid flow controlling device as claimed in claim 89 in which said flow control plunger (56) includes a flow-throttling position (FIG. 5), that is disposed intermediate of said flow-blocking position (FIG. 3) and said free-flow position (FIG. 4); and said flow control plunger is moved from said free-flow position to said flow-throttling position in response to a reduction in fluid pressure in said second work port channel (46) to a predetermined pressure magnitude when said valving element means (54) is in said second operating position (FIG. 5); whereby said flow control plunger is effective to control the rate of fluid flow from said first work port channel (44) to said return port means (49 or 50) as a function of the fluid pressure in said second work port channel (46).

92. A fluid flow controlling device as claimed in claim 89 in which said communication of said first work port channel (44) with said return port means (48 or 50) when said valving element means is in said second operating position (FIG. 3) comprises communication of said first work port channel with said branch channel (48); and said branch channel is communicated to said second work port channel (46) by a conduit (210), fluid flow from said second work port channel to said branch channel is prevented by a one-way flow valve (206) interposed into said conduit, and said device includes means (208) for limiting the fluid pressure in said conduit.

93. A fluid flow controlling device as claimed in claim 84 in which said device includes a second work port channel (46), said valving element means (54) is movable to a regenerative position wherein said first work port channel (44) is communicated to said branch channel (48), said branch channel is communicated to said second work port channel by a conduit (210), fluid flow from said second work port channel to said branch channel is prevented by a one-way flow valve (206) interposed into said conduit, and said device includes means (208) for limiting the fluid pressure in said conduit.

94. A fluid flow controlling device as claimed in claim 84 in which said flow controlling device (60) includes resilient bias means (120) for resiliently urging said flow control plunger (56) in said first direction to said flow-blocking position (FIG. 3).

* * * * *